73-151 SR
3/9/76 OR 3,942,373

United States Patent [19]
Rogers

[11] 3,942,373
[45] Mar. 9, 1976

[54] WELL TOOL APPARATUS AND METHOD

[75] Inventor: Austin S. Rogers, Houston, Tex.

[73] Assignee: Homco International, Inc., Houston, Tex.

[22] Filed: Apr. 29, 1974

[21] Appl. No.: 465,081

[52] U.S. Cl. ..... 73/151; 166/255
[51] Int. Cl.[2] ..... E21B 47/00
[58] Field of Search ..... 73/151; 166/250, 255; 336/130, 131, 135; 33/DIG. 5

[56] References Cited
UNITED STATES PATENTS 2,430,757 11/1947 Conrad et al. ..... 336/131 X
3,762,218 10/1973 Davis ..... 73/151

*Primary Examiner*—Jerry W. Myracle

[57] ABSTRACT

A new and improved well tool apparatus and method for sensing and testing conditions in a well, such as stuck drill pipe, temperature, metal creep, and the like, and for performing certain operations in the well, such as backing off, or loosening, the stuck pipe.

26 Claims, 19 Drawing Figures

Fig. 8
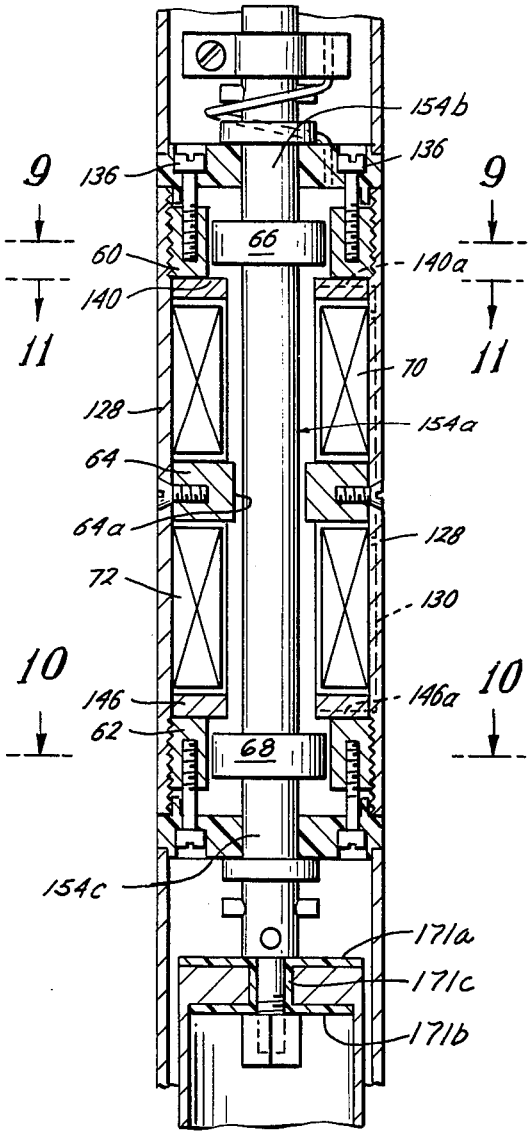
Fig. 9
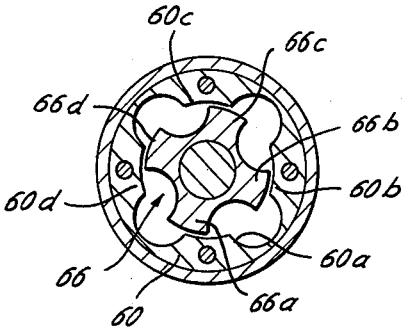
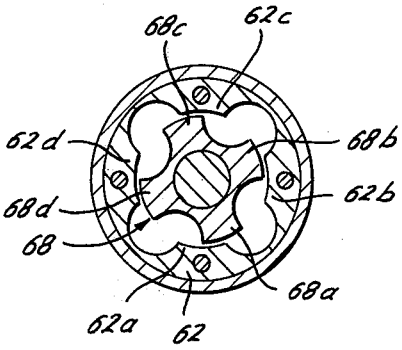
Fig. 10
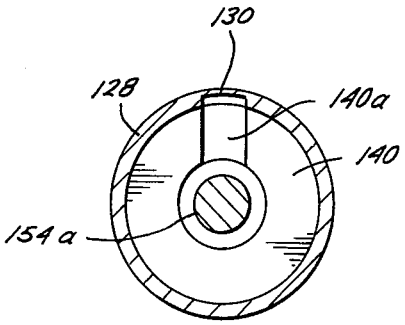
Fig. 11

WELL TOOL APPARATUS AND METHOD

BACKGROUND OF THE INVENTION

1. Field of the Invention

The present invention relates to testing conditions and performing operations in well bores.

2. Description of Prior Art

Prior art well testing apparatus, as exemplified by U.S. Pat. Nos. 2,686,039; 2,689,920; 2,717,039; 2,814,019; 2,817,808; 2,869,072; 3,004,427; 3,006,186; 3,095,736; and 3,233,170, have been used to locate the freepoint, or location at which pipe or tubing was stuck, in a well bore. Several problems have existed in the prior art.

Accuracy of the readings obtained in freepoint sensing has been limited by the linearity of the response and the range of displacement of the freepoint sensor. Alignment or placement of the freepoint sensor at a proper null or reference was necessary before reliable readings were obtained. However, movement of the sensor through the well bore into a position for testing often moved the sensor out of proper alignment.

Additionally, when a back-off tool was used to loosen the stuck pipe in conjunction with freepoint sensing, further problems arose. Isolation between electrical circuits of the freepoint indicator and back-off tool, necessary from a safety standpoint, was often difficult to maintain. Further, the shock formed when the back-off tool was used to loosen pipe often damaged the relatively sensitive downhole electronic circuits in the freepoint indicator.

Further problems have arisen for these tools when used in recently drilled wells which generally extend to greater depths than prior wells. Heat at these greater depths significantly limited the operation of the electronics used in the well tools, particularly in the freepoint indicators. The increased length of wireline necessary to lower the tools to the greater depths has increased the electrical resistance of the wireline, requiring an increase in the electrical current sent from the surface to insure operation of the backoff tool, thus increasing the voltage drop along the wireline.

SUMMARY OF THE INVENTION

Briefly, the present invention provides a new and improved well tool apparatus and method for sensing and testing conditions in a well bore and for performing certain operations in the well bore.

The apparatus and method of the present invention include a sensor for sensing whether the pipe is stuck at a test location in the well bore, and a reference means which moves the sensor into a reference position, or first operating position, at the test location in the well bore so that accurate readings can be obtained in response to movement of the pipe when stressed, and a means for forming a time delay, during which operation of the reference means takes place, once the sensor is at the test location so that the sensor may move into the proper reference position for accurate sensing operations.

The apparatus and method of the present invention further include a backoff means operable when the apparatus is at a second operating position which loosens pipe above the stuck point once the stuck point of the pipe is located, with the time delay forming means preventing movement of the apparatus from the second operating position to the first operating position during backoff operations so that the sensor and the structure moving the apparatus in the well are protected from shock and damage during backoff operations.

The sensor of the present invention includes a magnetic rotor and stator and an intermediate core which form a magnetic circuit whose parameters vary, and thus vary the inductance of a coil, in response to movement of the pipe when stressed, with improved accuracy resulting during freepoint sensing operations.

The apparatus and method of the present invention further permit backoff operations in deeper wells notwithstanding the increased wireline resistance due to the increased depths, by using alternating current which is sent at a reduced current level down the wireline and increased in amplitude to a desired level by a transformer adjacent the backoff tool.

The apparatus of the present invention provides a new and improved apparatus for sensing temperature conditions in a well bore and metal creep and the like in pipe in the well bore due to these temperature conditions, as well as a new and improved inclinometer for sensing the degree of inclination of a well bore.

It is an object of the present invention to provide a new and improved apparatus and method for operations such as freepoint sensing and backoff in pipe in well bores.

BRIEF DESCRIPTION OF THE DRAWINGS

FIG. 8 is a side view, taken partly in cross-section, of the sensor portion of the apparatus of FIGS. 2A and 2B;

FIGS. 9, 10 and 11 are cross-sectional views taken along the lines 9—9, 10—10 and 11—11, respectively, of FIG. 8;

DESCRIPTION OF THE PREFERRED EMBODIMENT

APPARATUS

Figure 1:
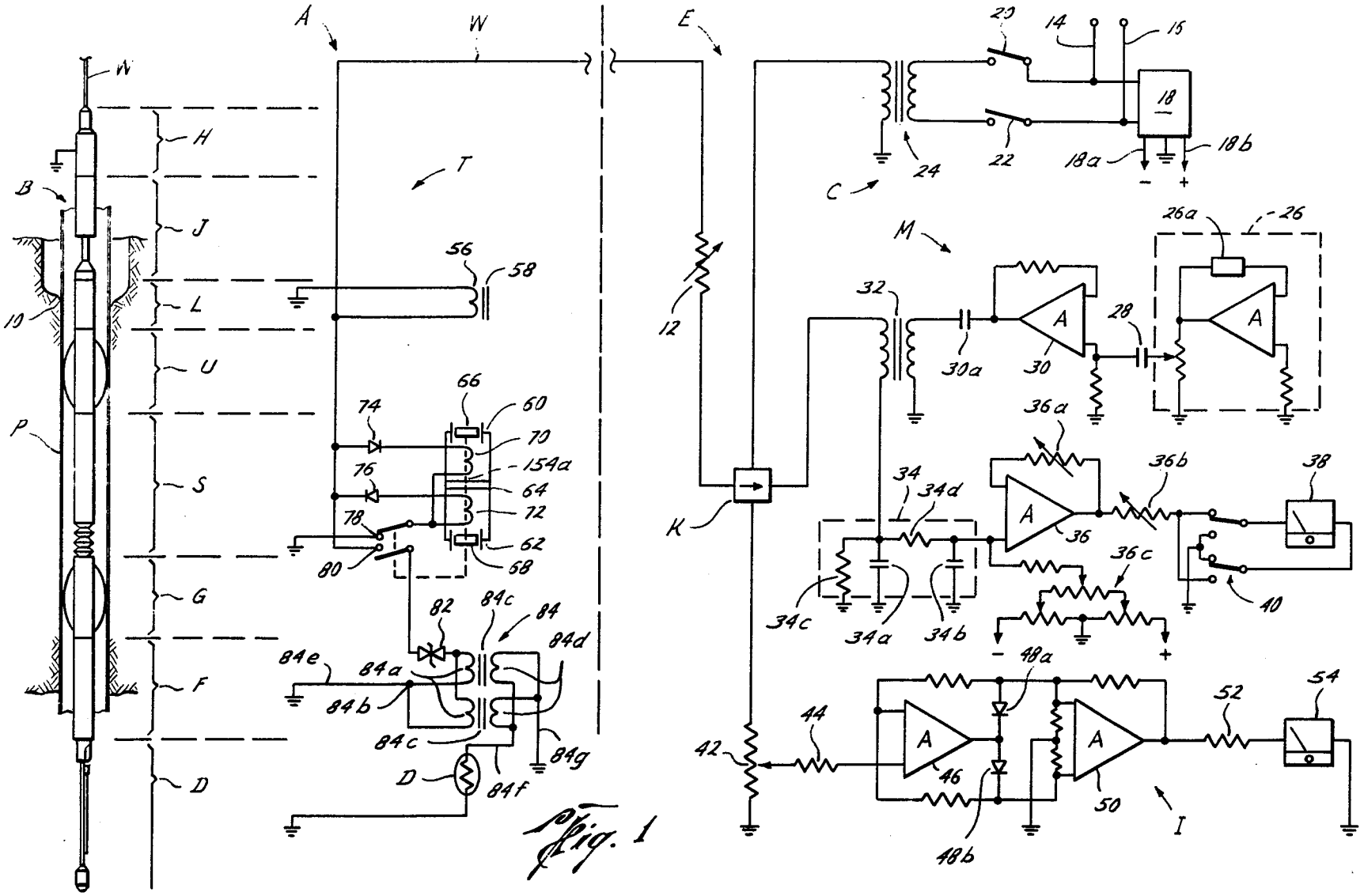
FIG. 1 is a schematic diagram of the apparatus of the present invention.

During drilling and other operations in a well bore B (FIG. 1), a pipe or casing P sometimes becomes stuck as indicated at 10 due to cave-ins and other subsurface earth movements and the like. In the drawings, the letter A (FIG. 1) designates generally the apparatus of the present invention for sensing and testing conditions at various test locations in the well bore B, which includes a surface electronic circuit E and a downhole tool T for use in the well bore B.

The downhole tool T is lowered through the well bore B by an electrically conductive wireline W. The tool T additionally has conventional sinker bars (not shown) mounted therewith in order to furnish additional weight to facilitate movement of the tool T through the pipe P in the well bore B.

The tool T includes a cable head subassembly, or sub, H which electrically connects the wireline W to the remainder of the tool T in the conventional manner. The cable head sub H has a conventional slip joint J mounted therebeneath which forms a mechanical and electrical connection between the cable headset H and a conventional casing collar locator L.

An upper bowspring U and a lower bowspring G mount a sensor unit S between spaced upper and lower portions of the drill pipe P in the well bore B. As will be set forth below, and as shown in FIG. 1, when the drill pipe P is stuck at the test location, the sensor S detects that the pipe is so stuck by sensing lack of movement of the pipe P. Alternatively, when the pipe P is free at the test location, relative movement of the drill pipe P when stressed by torque or tension from the surface is transmitted to the sensor means S by the upper bowspring U and lower bowspring G indicating that the drill pipe P is free at the test location. The tool T is moved through the bore B to various locations during testing.

The sensor unit S thus indicates in a manner to be set forth below, the point where the drill pipe is stuck so that a detonator or backoff shot or other conventional backoff apparatus D may be used, as will be set forth, to free the drill pipe P above the stuck point. A transformer sub assembly F transfers power to the detonator D while increasing the electrical current level, so that the power consumption and voltage drop along the wireline W is reduced permitting operation of the detonator D at increased depths for deeper wells, while assuring that proper operating voltage and current levels are presented to the detonator D, as will be set forth.

The surface electronic circuit E includes a detonator control circuit and power supply C, a collar locator indicator circuit I and a sensor monitor circuit M which are selectively electrically connected to the downhole tool T by a multi-position control switch K through a variable resistor 12. The variable resistor 12 is adjusted for impedance matching with the resistance and impedance of the downhole tool T and wireline W.

The detonator control circuit C receives alternating current input power over input conductors 14 and 16 from a suitable alternating current source, such as a generator at the drilling rig or the like. A power supply circuit 18, a conventional voltage regulating direct current power supply, receives the incoming alternating current power from the conductors 14 and 16 and provides positive direct current bias potential at a positive output terminal 18*a* and negative direct current bias potential at a negative output terminal 18*b*. The power supply 18 thus provides operating direct current potential for the electronic circuits in the monitor circuit M and the indicator circuit I. The power supply 18 may be of the type providing plural direct current bias levels if the electronic components of the circuit E so require.

A first control switch 20 and a second control switch 22 of the detonator control circuit C electrically connect input alternating current power when closed from the input conductors 14 and 16 to a current reducing transformer 24 so that the detonator D may be energized when the control switch K is in the proper position. It is preferable to use two control switches 20 and 22 in order to prevent inadvertent depression of a single control switch causing operation of the detonator D at an improper time, although it should be understood that only one control switch in the control circuit C may be used, if desired. The current reducing transformer 24 reduces the current received over the input conductors 14 and 16 to a low level, so that the current sent through the control switch K and the wireline W to the detonator D is at a low level and thereby the voltage drop due to the resistance of the wireline W is reduced. The transformer F increases the current level from that received over the wireline W to a sufficiently high level to energize the detonator D.

The monitor circuit M of the surface electronics E includes a conventional operational amplifier oscillator circuit 26 providing output alternating current with a predetermined frequency through a coupling capacitor 28 and a buffer operational amplifier 30 to an isolation transformer 32. The oscillator 26 has an output frequency determined by the phase shift imposed on a portion of its output signal and fed back to its input terminal through a conventional R-C feedback impedance network 26*a*.

The buffer amplifier 30 provides an impedance match between the oscillator 26 and the isolation transformer 32 and furnishes the output alternating current signal from the oscillator 26 through a coupling capacitor 30*a* to the transformer 32 so that the output signal from the oscillator 26 is furnished through the control switch K, when such switch is in the proper position, to the sensor unit S over the wireline W for freepoint sensing operations, to be set forth below. Isolation transformer 32 further prevents direct current offset signals formed in the sensor unit S during freepoint sensing from charging capacitor 30*a*.

The monitor circuit M further includes an integrator or low pass filter 34 which responds to the direct current offset signal formed by the sensor means S and accumulates charge in integrating capacitors 34*a* and 34*b* therein. A resistor 34*c* is connected in parallel with the capacitors 34*a* and 34*b* and a resistor 34*d* is connected in series between such capacitors to set a time constant for the integrator 34. The voltage represented by the stored charge in the capacitors 34*a* and 34*b* of the integrator circuit 34 is provided through an offset amplifier 36 having a control variable feedback resistance or potentiometer 36*a*, a variable calibration resistance or potentiometer 36*b* and a bias network 36*c* permitting a direct current voltmeter 38 to be set to a zero or null reading when the sensor unit S has been moved to the reference position, in a manner to be set forth below.

A two position switch 40 electrically connects the meter 38 to the output from amplifier 36 and the integrating network 34 so that positive and negative polarity direct current offset readings from the sensor unit S may be sensed by the monitor circuit M.

A gain control potentiometer 42 and input resistance 44 electrically connect the collar locator indicator circuit I through the control switch K to the collar locator L of the tool T. The potentiometer 42 is adjusted to set the current output level of the collar locator L furnished to the indicator circuit. The indicator circuit I includes an input amplifier 46 electrically connected through rectifying diodes 48*a* and 48*b* to a buffer amplifier 50 so that the alternating current output from the collar locator L is rectified and provided as a direct current signal through the amplifier 50 and a connecting resistor 52 to a direct current voltmeter 54 which provides a direct current output reading in response to the proximity of the collar locator L to a drill pipe collar in the drill pipe P, as is conventional in the art.

The electrical portion of the downhole tool T includes a coil 56 and magnetic core 58 of the collar locator L which responds to the proximity of the collar locator L to a casing generating an electromotive force (EMF) in the coil 56 which is sensed at the meter 54 of the indicator of the indicator I in the surface electronic portion E.

The sensor S is electrically connected through the wireline W and the line compensating resistance 12 through the multiposition control switch K to the monitor circuit M. The sensor S includes a first ferromagnetic stator core 60 operably connected through the upper bowspring U at a first point of contact to pipe P and a second, or lower, ferromagnetic stator core 62 which is also operably connected to the pipe P at the first contact point thereof by means of the upper bowspring U, as will be set forth below. The sensor unit further includes an intermediate ferromagnetic core 64 operably connected with the first contact point of the pipe along with the stator cores 60 and 62.

The sensor S further includes a first, or upper, ferromagnetic rotor core 66 and a second, or lower, ferromagnetic rotor core 68, each of which is operably connected with a second point of contact of the pipe P by means of the lower bowspring G spaced from the first point of contact with the pipe P. A first or upper inductive coil 70 is mounted between the first stator 60, the intermediate core 64 and the first rotor core 66. Similarly, a second inductive coil 72 is mounted between the second stator core 62, the second rotor core 68 and the intermediate core 64.

The stator core 60, the rotor core 66 and the intermediate core 64 form a ferromagnetic circuit whose reluctance and other ferromagnetic parameters change in response to relative movement between the first and second spaced points of contact with the pipe P, varying the inductance of the inductive coil 70 so that relative movement of the pipe P forms a current sensed by the monitor circuit M of the surface electronics E to indicate that the pipe P is not stuck at the test location. In a like manner, relative movement of the first and second spaced contact points of the pipe changes the parameters of the magnetic circuit formed by the second stator core 62, the second rotor core 68 and the intermediate core 64, varying the inductance of the inductive coil 72 to indicate relative movement of the spaced portions of the pipe P. As will be set forth below, the reference position mounting of the rotor cores and stator cores in the sensor S provides an accurate and sensitive indication of movement of the pipe P during freepoint sensing.

Figure 7:
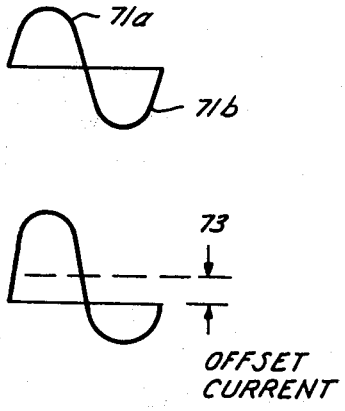
FIG. 7 is a schematic waveform diagram of voltage waveforms present in the apparatus of FIG. 1.

The sensor means S is energized by alternating current sent down from the oscillator 26 of the surface electronics E through the control switch K, the line compensating resistor 12 and the wireline W. Unidirectionally conductive diodes 74 and 76, or other suitable unidirectionally conductive circuit components energize the inductive coil 70 and the second inductive coil 72 on alternate half-cycles 71*a* and 71*b*, respectively, (FIG. 7) of the alternating current. Due to the alternate energization of the inductive coil 70 and 72, variations in the reluctance parameters of the ferromagnetic circuit in the sensor S due to relative movement between the upper bowspring U and lower bowspring G during freepoint testing result in an offset direct current, as indicated at 73, to be formed in the sensor S in response to movement of the pipe P. The polarity of the direct current offset further indicates the direction of movement of the pipe P. This direct current offset current provides increased accuracy freepoint readings and permits use of relatively temperature insensitive magnetic components in the sensor S, without requiring additional downhole electronics which are temperature sensitive and thus undesirable for use in deeper wells.

The downhole tool T is movable between a first operating position for sensing operations by the sensor S at a test location in the bore B and a second operating position for backoff operations by the detonator D at the test location. A sensor contact 78 completes an electrical circuit through the sensor S to an electrical ground when the downhole tool is in the first operating position, electrically connecting the sensor S to the wireline W by completing the electrical circuit therebetween. A backoff contact 80 electrically connects the detonator D to the wireline W when the downhole tool T is in the second operating position permitting backoff operations. As will be set forth below, the sensor contact 78 and the backoff contact 80 are mutually exclusively operable, electrically isolating the sensor means S from the detonator D during downhole operations. This electrical isolation between the sensor S and detonator D protects the ferromagnetic circuits of the sensor D from being excessively or permanently magnetized by the high voltage sent down the wireline W to activate the detonator D, and also prevents power loss in the sensor S by sensor loading during backoff operations insuring full power transfer to the detonator D from the wireline W.

A voltage threshold responsive means, such as a Zener diode 82, electrically connects the backoff contact 80 to a current increasing transformer 84 in the transformer sub F of the downhole tool T. The Zener diode 82 serves as further protection and isolation between the sensor S and the detonator D by preventing sensor voltage from the sensor S from firing the detonator D during sensing operations and other operations.

The transformer 84 has two primary coils 84*a* electrically connected in parallel between the Zener diode 82 and a tap 84*b* electrically connected by a return conductor 84*e* to ground. Two magnetic cores 84*c* magnetically link each primary 84*a* of the transformer 84 to a corresponding secondary coil 84*d* thereof. The secondary coils 84*d* are electrically connected by a conductor 84*f* to the detonator D and to electrical ground by a ground conductor 84*g*. The turns ratio between the primary coils 84*a* and secondary coils 84*d* of the transformer 84 is chosen to be a sufficiently large ratio, for example 20:1, so that the level of the electrical current sent from the control circuit C through the switch K over the wireline W to the detonator D is significantly increased in the transformer 84. In this manner, a low level current can be sent over the wireline W, decreasing the voltage drop due to the resistance in the wireline, reducing power loss therein, while insuring sufficient current to ignite the detonator D, particularly those detonators for high temperature well operations which require high current levels to ignite, and permit backoff operations in the well bore B once the stuck point of the pipe P has been located by the sensor S, in a manner to be set forth below. It should be understood that transformers with a single primary coil and secondary coil, or more than two sets of primary and secondary coils are also suitable for use with the present invention. The dual arrangement shown was used as a convenience only to fit the transformer into the successfully constructed embodiment.

SENSOR AND TIME DELAY

An upper sub 86 of the sensor S (FIG. 2A) is mounted at a threaded surface 86*a* to a lower end 88 of the upper bowspring assembly U, with an O-ring 90 or other suitable sealing means mounted therebetween. A sensor sub 92 is mounted at an upper end 92*a* thereof to a lower threaded end 86*b* of the upper connector sub 86, with an O-ring 94 or other suitable sealing means mounted therebetween. A fluid seal block 96 is mounted within the sensor sub 92 adjacent the lower end 86*b* of the upper connector sub 86, and an O-ring 97 is mounted between seal block 96 and sub 92.

A threaded socket 96*a* is formed in the fluid seal block 96 and receives a conduit post 98 formed from suitable insulative material along a threaded surface 98*a* thereof. A conventional banana plug 100 is mounted with its associated lock washer and solder lug at an upper end 98*b* of the conduit post 98 in order to form an electrical connection between the sensor S through the upper bowspring U to the collar locator L and the wireline W. A conduit 102 is formed extending downwardly through the conduit post 98 in order that electrical conductors (not shown) may electrically connect the banana plug 100 to electrical connector plugs 104 mounted in associated conduits 96*b* in the fluid seal block 96.

A plurality of solder lugs 106 are mounted in the conduit 102 in order to hold the electrical conductors in place therein. A collar 108 made of a suitable heat absorbing material is mounted as a heat sink in an annular groove adjacent a surface 98*c* formed on the conduit post 98. The heat sink collar 108 surrounds a portion of the post 98 and a trough 110 therein containing the unidirectionally conductive diodes 74 (FIG. 2A) and 76 (FIG. 1) which are electrically connected by suitable conductors (not shown) to the banana plug 100 and connector plugs 104 and the collar locator L and the wireline W, as has been set forth.

A threaded inlet port seal or pipe lug 112 is mounted in a threaded socket 92*b* formed in the sensor sub 92 to permit the sensor S to be filled through an inlet chamber 114 so that the sensor S may be filled with a suitable fluid, such as a silicone base fluid adapted for use at various downhole temperatures.

An electrically insulative four jack terminal or block 116 is mounted by conventional mounting screws (not shown) with a sensor spacer sleeve 120 in the sensor S. Four electrical connector jacks 122, two of which are shown (FIG. 2A) are mounted within the terminal 116 and provide electrical connection there-through so that electrical connection is formed between the wireline W through the sensor S to the inductive coils 70 and 72 and to the detonator D. An inner passage 116*a* is formed in the terminal 116 to permit return of the requisite electrical conductors (not shown) from the inductive coils and to permit passage of the fluid from the chamber 114 to the remainder of the sensor S therebelow in order that the interior of the sensor S may be filled with such fluid.

Electrically conductive threaded sleeves 124 are mounted with lower ends of connector jacks 122 in order to provide a flow path for electrical current through the insulating block 116. Suitable mounting screws hold the block 116 in place in the spacer 120.

The magnetic sensing portion of the sensor S (FIGS. 2A, 2B and 8–10) is mounted with an upper support sleeve or bearing 126 mounted in place between the upper sensor spacer 120 and a sensor covering sleeve 128. The upper sleeve bearing 126 has plural ports formed extending vertically therethrough for passage of fluid from the chamber 114 thereabove into an interior chamber 129 in the sensor S. An inner magnetic shield sleeve 132 and an outer magnetic shield sleeve 134 enclose the magnetic sensor portion of the sensor S in order that magnetism in the drill tubing does not unduly affect operation of the sensor S. The inner shield sleeve 132 and the outer shield sleeve 134 are formed from a suitable magnetic shielding material, such as that known in the art as mumetal.

Figure 2A:
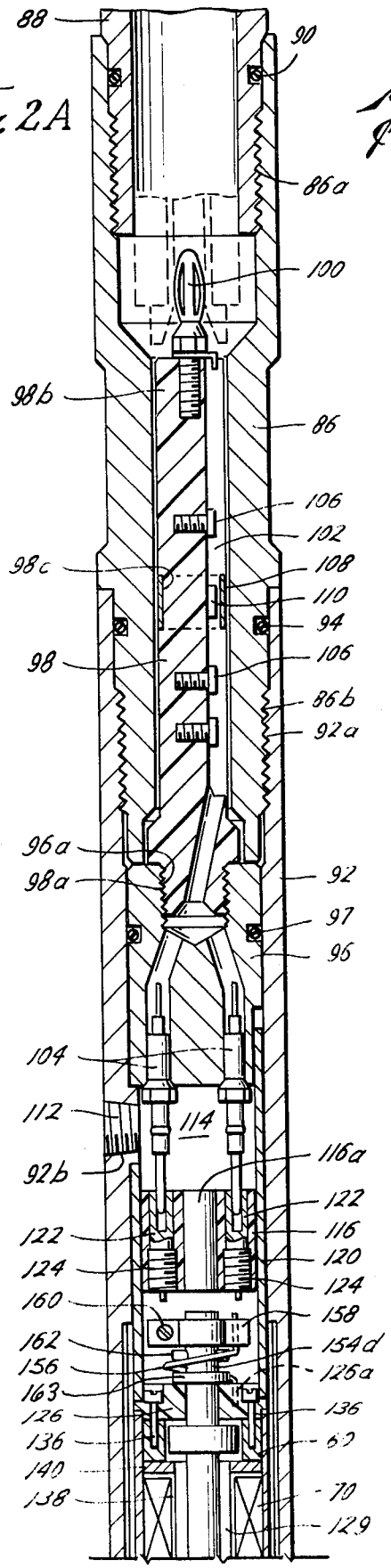
FIGS. 2A through 2D are side views, partially in section, from top to bottom, respectively, of a portion of the apparatus of FIG. 1.
Figure 2B:
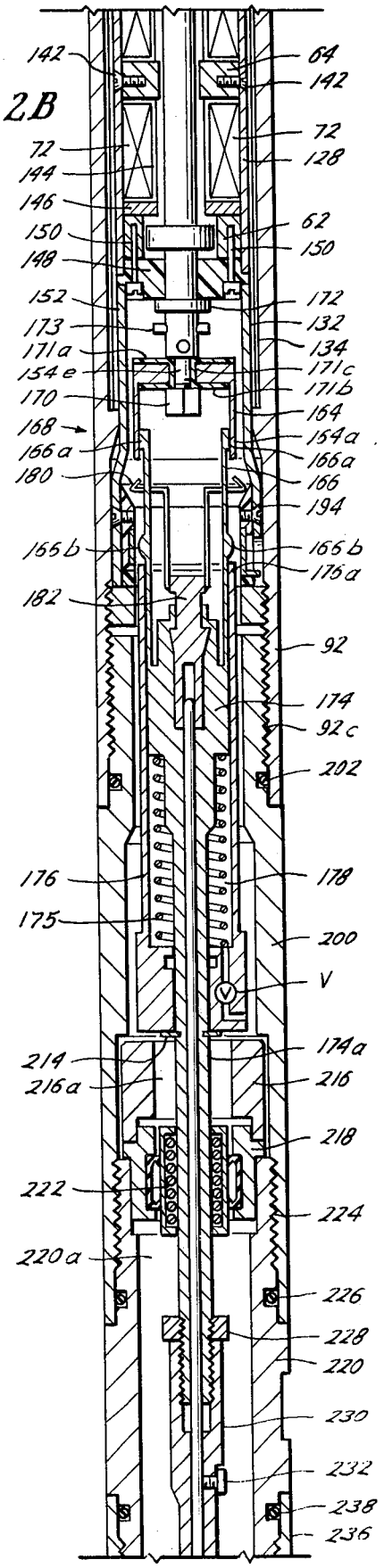

The first annular stator core 60 is mounted with the sleeve bearing 126 by downwardly extending screws 136, or other suitable fastening means. The stator core 60 is further externally threaded to engage a threaded inner surface in the sleeve 128 (FIG. 8), with the threaded surfaces not shown in FIG. 2A to more clearly show other structural details. The annular intermediate ferromagnetic core 64 is mounted with the sleeve 128 by set screws 142 (FIG. 2B). The first inductive coil 70 is wound about a spool or bobbin 138 held in place between the annular ferromagnet 60 and the ferromagnetic core 64 by an annular spacer 140. The spool 138 is preferably formed from a suitable non-magnetic material, such as a synthetic resin.

The second, or lower, annular stator core 62 is mounted with a sleeve bearing 148 by plural mounting screws 150 or other suitable attaching means. The core 62 is further externally threaded to engage a threaded inner surface in the sleeve 128 (FIG. 8), with such threaded surfaces not shown in FIG. 2B to more clearly show other structural details. The second, or lower, inductive coil 72 is wound about a spool or bobbin 144 held in place between the intermediate core 64 and the second stator core 62 by a lower annular spacer 146. The terminal 148 is mounted between the sleeve 128 and a lower sensor spacer 152. The terminal 148, in a like manner to the upper bearing 126, has plural fluid passage ports formed therein for passage of fluid from the chamber 129 to the remainder of the interior of the apparatus A therebelow.

A groove or race 130 (FIGS. 8 and 11) is formed in the sensor covering sleeve 128 in communication with a groove 140*a* formed in the spacer 140 and a like groove 146*a* formed in the spacer 146. The groove 130 permits passage of electrical conductors (not shown) through the cover 128 to openings 130*a* and 130*b* (shown in phantom in FIG. 8) in order to electrically connect the coils 70 and 72 to the wireline W (FIG. 1).

The stator core 60 has plural ferromagnetic pole pieces 60*a*, 60*b*, 60*c* and 60*d* formed thereon extending inwardly (FIG. 9) towards a corresponding plurality of outwardly extending ferromagnetic core pole pieces 66*a*, 66*b*, 66*c* and 66*d* of the upper rotor 66.

The second or lower, annular stator core 62 has plural ferromagnetic pole pieces 62*a*, 62*b*, 62*c* and 62*d* formed thereon extending inwardly (FIG. 10) towards a corresponding plurality of outwardly extending pole pieces 68*a*, 68*b*, 68*c* and 68*d* of the lower, or second, rotor 68.

The upper rotor 66 is mounted by a set screw (not shown) or other suitable mounting means with a rotatable and longitudinally movable shaft 154 (FIG. 8). The shaft 154 is formed from a central ferrous rod 154*a*, formed from a suitable ferromagnetic material with a non-ferrous material upper end 154*b* and a non-ferrous lower end 154*c* welded or otherwise suitably mounted therewith.

The upper ferromagnetic rotor 66 is mounted with the central ferrous rod 154*a* adjacent the junction of the central ferrous rod 154*a* and the upper end 154*b* (FIG. 8). The lower ferromagnetic rotor 68 is mounted by a set screw (not shown) or other suitable mounting means with the central ferrous rod 154*a* adjacent the junction of such ferrous rod 154*a* and the lower end 154*c*. The upper stator core 60, the upper rotor 66, the upper portion of the ferrous rod 154*a* and the intermediate core 64 form a magnetic circuit including such core elements and the air gaps between individual ones thereof. A magnetic flux flows through this magnetic circuit and the intensity of such flux controls the inductance of the coil 70. Relative movement of the ferromagnetic core components of this magnetic circuit with respect to each other in response to movement of the pipe P when stressed or torqued changes the reluctance in such magnetic circuit, varying the inductance of the coil 70 forming a current sensed by the monitor circuit M of the surface electronics E.

In a like manner, the lower stator core 62, the lower rotor core 68, the lower portion of the ferrous rod 154*a* and the intermediate core 64 form a second magnetic circuit including such core elements and the air gaps between such elements. A magnetic flux flows through this magnetic circuit and the intensity of such flow establishes the inductance of the second, or lower, inductive coil 72 so that relative movement of the ferromagnetic core components of this second magnetic circuit with respect to each other in response to movement of the pipe P changes the reluctance of the second magnetic circuit, varying the inductance of the coil 72, forming a current sensed by the monitor circuit M.

With the present invention, it has been found that the upper rotor core 66 and the lower rotor core 68 can be mounted with the ferrous rod 154*a* with respect to the upper stator core 60 and the lower stator core 62, respectively, so that relative movement of the pipe P when stressed on the surface changes the inductance of the coils 70 and 72 to form a unidirectionally offset current, providing freepoint readings of increased accuracy and sensitivity.

The upper rotor core 66 is mounted with the ferrous rod 154*a* (FIG. 9) so that the pole pieces 66*a*, 66*b*,66*c* and 66*d* thereof are aligned with respect to the corresponding pole pieces 60*a*, 60*b*, 60*c* and 60*d*, respectively, of the upper stator core 60 over only a fractional extent thereof (FIG. 9). In this manner, a relatively slight rotational movement of the shaft 154, either clockwise or counterclockwise, in response to relative movement between the upper bowspring U and the lower bowspring G causes a significant decrease or increase, respectively, in the common surface area between the pole pieces of the rotor core 66 and the stator core 60, with a corresponding change in the reluctance parameter of the magnetic circuit. Such change in the reluctance in the magnetic circuit causes a corresponding change in the inductance of the coil 70, with a corresponding change in the current sensed by the monitor circuit M. The lower rotor core 68 is mounted with the ferrous rod 154*a* so that the pole pieces 68*a*, 68*b*, 68*c* and 68*d* thereof are aligned with respect to the corresponding pole pieces 62*a*, 62*b*, 62*c* and 62*d*, respectively, of the lower stator core 62 for only a fractional extent thereof (FIG. 10). In this manner, a relatively slight rotational movement of the shaft 154, either clockwise or counterclockwise, in response to relative movement between the upper bowspring U and the lower bowspring G causes a significant increase or decrease, respectively in the common surface area between such pole pieces of the second magnetic circuit, causing a corresponding change in the inductance of the coil 72, with an attendant change in the current sensed by the monitor circuit M.

It is noted, for reasons to be set forth below, that due to the mounting of the rotor cores 66 and 68 with respect to the stator cores 60 and 62, respectively, relative counterclockwise movement of shaft 154 increases the inductance of the upper coil 70 while decreasing the inductance of the lower coil 72. Accordingly, energization of the upper coil 70 on positive half-cycle 71*a* of current from the oscillator O has an increased current flow therethrough, while energization of the lower coil 72 on negative half-cycle 71*b* of the current from the oscillator O causes a decreased current forming the offset current 73 in the manner set forth above, providing freepoint readings of improved accuracy and sensitivity.

The annular intermediate magnetic core 64, in contrast to the stator core 60 and 62 has no inwardly extending pole pieces formed thereon, but rather has an interior face 64*a* extending circumferentially (FIG. 8) about the ferrous shaft 154*a* and being equidistant in spacing therefrom about such circumferential extent. Accordingly, relative longitudinal and rotational movement of the shaft 154 with respect to the intermediate core 64 does not affect the common surface area between such shaft and such core and thus does not affect the reluctance parameters of the magnetic circuits of the sensors S, permitting the relative movement between the pole pieces of the rotor cores 66 and 68 and the pole pieces of the stator cores 60 and 62, respectively, to vary the parameters of the magnetic circuit of the sensor S and provide an indication of movement of the pipe P of improved accuracy.

The upper rotor core 66 and the lower, or second rotor core 68 accordingly move with the movable shaft 154 in order that relative movement between the upper bowspring U and the lower bowspring G in response to movement of the pipe P when stressed or torqued is transmitted to the sensor S in order that relative movement of the pipe P may be sensed in the sensor S.

A reference resilient spring 156 (FIG. 2A) is mounted with a clamp 158 held in place by a bolt 160 at an upper end 154*d* of the rod 154. The resilient spring 156 passes about a stop pin 162, mounted with the rod 154, which limits vertical movement of the rod 154, and into a downwardly extending socket 126*a* formed in the bearing 126 (FIG. 2A). A stop and shock absorber 163 of suitable resilient material engages the stop pin 162 at the lower movement limit.

The resilient spring 156 forms a reference means moving the sensor S into a reference position and aligning the pole pieces of the rotor cores 66 and 68 with respect to those of the stator cores 60 and 62, in the alignment set forth above, so that slight changes in the magnetic parameters of the magnetic circuit of the sensor S in response to movement of the pipe P may be detected for more accurate downhole readings in order to locate the free point in the well bore B. The reference spring 156 moves the sensor S into the reference, or first operating position in the absence of action of a retaining means 168 having a normal operating position restraining the operation of the reference spring 156 when the sensor S is being moved through the well bore B by the wireline W into position for sensing operations. In this manner, the sensor S is not required to be in the reference position while being lowered or raised through the well bore B, preventing possible damage or misalignment of such sensor during movement in the well bore B.

The retaining means 168 (FIG. 2B) includes a receiving cup or clutch cup 164 and upwardly extending fingers 166 which restrain the reference spring 156 when the sensor S is moved through the well bore B by the wireline W. The receiving cup 164 is mounted with a threaded lower end 154*e* of the shaft 154 by a bolt 170 or other suitble fastening means. The receiving cup 164 is electrically connected by a conventional set screw to ground conductors (not shown) from the coils 70 and 72. The cup 164 is electrically insulated from the shaft 154 by disk insulators 171*a* and 171*b* and on insulating bushing 171*c* (FIG. 8).

A stop and shock absorber 172 is preferably formed from a suitable resilient material for shock absorbing purposes and is mounted on the lower insulative support terminal 148. A stop pin 173 is mounted extending outwardly from the rod 154 below the absorber 172 and engages the absorber 172 to form an upper limit for movement of the shaft 154 to protect the sensor S from damage by unrestricted movement.

The freepoint contact fingers 166 are formed extending upwardly from a time delay piston 174 (FIG. 2B) which is relatively movable with respect to a delay housing 176 having a chamber 178 therein adapted to receive the fluid injected into the sensor S through the inlet port 112 (FIG. 2A). The freepoint finger contacts 166 have lugs 166*a* formed extending outwardly therefrom to engage an inner surface 164*a* formed in the receiving cup 164 when the sensor S is in a first operating position (FIG. 2B) for sensing operations so that relative movement of the pipe P when stressed or torqued from the surface causes relative movement between the upper bowspring U and the lower bowspring G. The freepoint contact fingers 166 further perform the function indicated schematically by the switch 78 (FIG. 1) grounding the coils 70 and 72 during freepoint sensing by contacting the cup 164 which is electrically connected to such coils in the manner set forth above.

Figure 3:
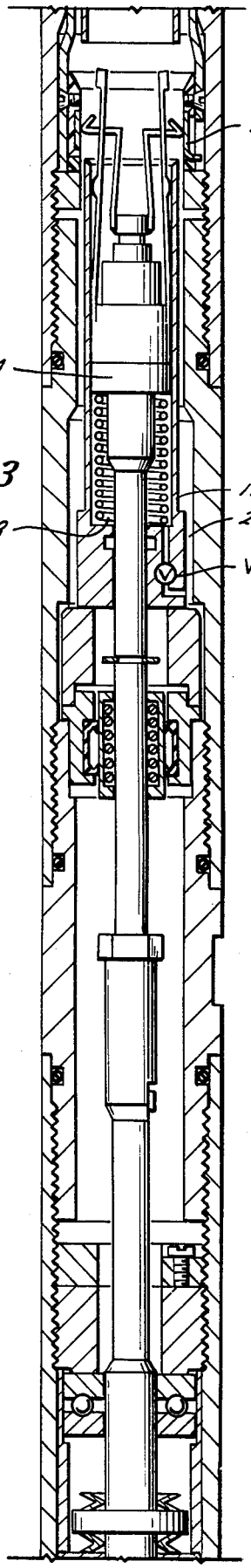
FIGS. 3 and 4 are side views taken partly in section, of the aparatus of FIGS. 2A through 2D, with the parts thereof moved to different operating positions.

Outwardly extending shoulders 166*b* are formed on the freepoint contact fingers 166 below the lugs 166*a*. The shoulders 166*b* are adapted to engage an upper end 176*a* of the delay housing 176, moving the lugs 166*a* out of engagement with the inner surface 164*a* of the receiving cup 164 (FIGS. 3 and 4), for reasons to be more evident below.

Shooting contacts 180 of backoff contact 80 are mounted with a shooting rivet 182 to provide electrical connection between the wireline W and the detonator D when the sensor and time delay unit S is in a second operating position at a test location in the well bore B for backoff operations. Structural details of the mounting arrangement for the shooting contacts 180 and the shooting rivet 182 are not set forth in FIG. 2B, in order to preserve clarity therein, but are rather set forth in FIG. 4. Additionally, the shooting contacts 180 and shooting rivets 182, and the freepoint finger contacts 160 are shown in the same plane (FIG. 2A through 2D, 3 and 4) for ease of illustration. However, in actual use of the apparatus A, the freepoint contact fingers 166 are mounted in the sensor S in a plane (FIG. 5) transverse that of the shooting contacts 180 and shooting rivets 182.

Considering the structural details of the mounting of the shooting contacts 180 and the shooting rivet 182 (FIG. 4), the shooting rivet 182 is mounted with a jack 184 mounted within a shooting insulator tube 186 in a socket 174*a* formed in an upper portion of the delay piston 174. The jack 184 forms an electrical connection at a lower end 184*a* with a shooting lead 188 covered with an insulated coating (omitted for the sake of clarity) except at an upper end 188*a* thereof.

Figure 4:
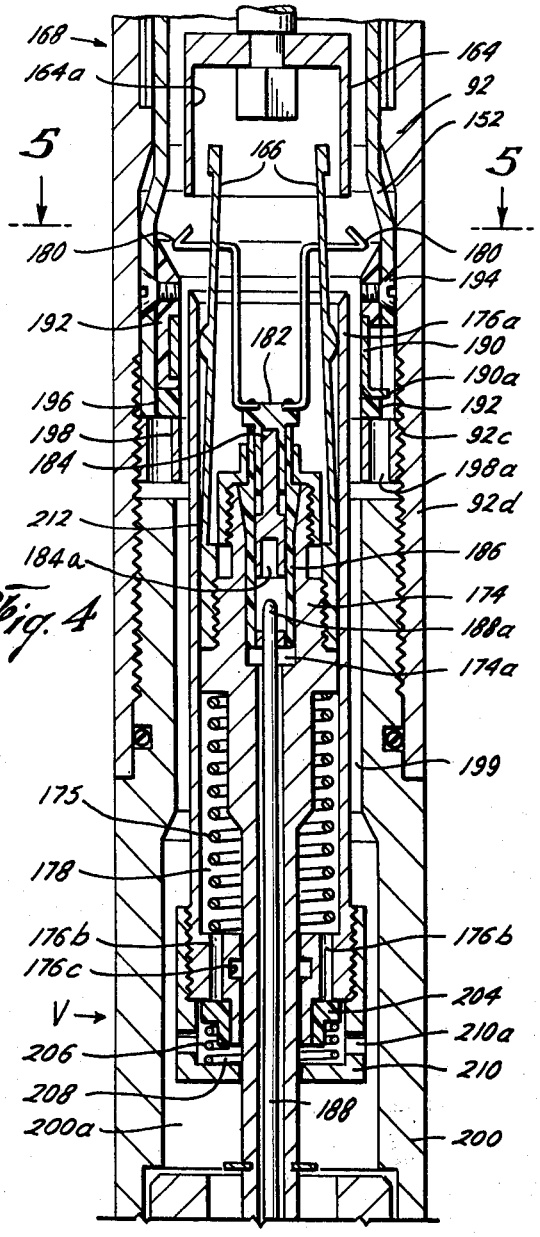
Figure 5:
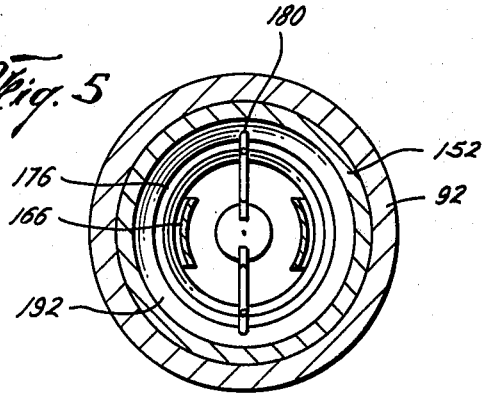
FIG. 5 is a cross-sectional view taken along the lines 5—5 of FIG. 4.

The shooting contacts 180 form an electrical connection between the shooting lead 188 and a shooting insert ring 190 when the apparatus A is in a second operating position (FIG. 3), or backoff position, for energizing the detonator D and loosening of the pipe after stuck point thereof has been found. An ear 190*a* (FIG. 4) formed on the shooting insert ring 190 forms an electrical connection with the electrical conductor (not shown) to the detonator D passing from the four-jack terminal 116 past the sensor S. The shooting insert ring 190 is mounted within an upper shooting insert insulator 192 mounted with the lower sensor spacer 152 by set screws 194 (FIG. 2B and 4). A lower shooting insert spacer 196 is mounted beneath the shooting contact ring 190 and held in place by a shooting lock nut 198 having a threaded external surface engaging a threaded internal surface 92*c* at a lower end 92*d* of the sensor sub 92 (FIG. 4). The lock nut 198 has ports 198*a* (FIG. 4) formed therein so that the fluid introduced into the inlet 112 may pass therethrough to an annular interior chamber 199 externally of the delay housing 176.

A delay housing sub 200 (FIG. 2B) is inserted at a threaded upper surface thereof into the threaded surface 92*c* at the lower end 92*d* of the sensor sub 92 beneath the shooting locknut 198 and an O-ring 202 or other suitable sealing means is mounted between the subs 92 and 200. The delay housing 176 and the delay piston 174 are mounted within the annular interior chamber 199 formed within the delay housing sub 200. The interior chamber 199 in the delay housing sub 200, together with the interior of the sensor sub 92 thereabove including the chamber 114 are filled with the fluid of the type set forth above, as is the chamber 178 in the delay housing 176.

In its most general sense, and as is set forth in detail herein, the invention provides a resilient fluid mounting for delay housing 176 with an inherent slow settling time. More specifically, the upper spring U is fixed to the sub 200, the lower spring G is fixed to the piston 174, and the delay housing 176 effectively "floats" between the two. The fluid flows in this area produce the various advantages, as is set forth herein.

The piston 174 is movable with respect to the delay housing 176 in the chamber 178 to a contracted position (FIGS. 3 and 4) from an expanded position (FIG. 2B). Movement of the piston 174 in the chamber 178 takes place in accordance with relative movement of the upper bowspring U with respect to the lower bowspring G, in a manner to be set forth below, in accordance with force exerted on the wireline W from the surface.

As the piston 174 moves from the expanded position (FIG. 2B) to the contracted position (FIGS. 3 and 4) a valve V (shown schematically in FIGS. 2B and 3, whose structural details are set forth in FIG. 4), permits release of fluid from the chamber 178. However, as will be set forth below, the valve V prevents inlet of fluid into the chamber 178 (FIG. 4) when the piston 174 experiences relative motion to the expanded position from the contracted position, forming a time delay affording several important features of the present invention.

A plurality of ports **176*b* (FIG. 4) are formed in a lower portion of the delay housing 176 providing fluid communication from the chamber 178 to an annular delay seat 204. The delay seat 204 is resiliently urged to a position blocking the ports 176*b* by a coil spring 206 held in place in a delay outlet chamber 208 formed between the delay housing 176 and a delay nut 210 which is free to move relative to the piston together with the delay housing 176. Outlet ports 210*a* are formed in the delay nut 210 permitting escape of the fluid from the delay outlet chamber 206 into the chamber 200*a* within the ball bushing sub 200.**

Accordingly, as the upper bowspring U moves with respect to a stuck lower bowspring G during the operation of the apparatus A, relative motion occurs between the piston 174 and the housing 176 which varies the size of the chamber 178 therebetween. As the housing 176 moves up from the expanded position (FIG. 2B) to the contracted position (FIG. 3), the fluid in the chamber 178 is forced outwardly past the valve V into the chamber **200*a*. On relative movement between the lower bowspring G and a stuck upper bowspring U, however, the valve V prevents rapid reverse flow of the fluid from the chamber 200*a* into the chamber 178, causing the housing 176 to move upwardly with the piston 174, retaining the freepoint contact fingers 166 in place within the upper end 176*a* of the housing 176 and holding the lugs inwardly with respect to, and out of engagement with the interior surface 164*a* of the retainer cup 164 (FIG. 4**).

A first leakage orifice 212 is formed in the annular space between the piston 174 and the housing 176 at an upper end thereof (FIG. 4) and a second leakage orifice is formed adjacent an annular groove **176*c* in the housing 176, through which orifices fluid in the chamber 200*a* seeps gradually when the piston 174 is in the contracted position in housing 176 (FIG. 4). The spring 175 in the chamber 178 urges the housing 176 downwardly with respect to the piston 174 reducing the pressure in the chamber 178 and causing seepage of fluid past the leakage orifice 212 at a slow rate. The time during which this seepage occurs is a time delay during which the shoulders 166*b* of the freepoint contact fingers 166 slowly move out of contact with the upper end 176*a* of the housing 176, permitting the (ugs 166*a* to move gradually outwardly into engagement with the inner surface 164*a* of the retaining cup 164. The time duration for this movement is a suitable time delay for movement of the sensor S between the first and second operating positions, which during the operation of the present invention isolates and protects the sensor S from damage during operation of the detonator D, permits the retaining spring 156 to move the magnetic circuits of the sensor S into the proper reference position for more accurate readings at test locations of interest in the well bore, permits minor movements of the apparatus A to settle out before sensing operations begin, and further protects the uphole structure of the apparatus A above the retaining means 168** from damage during operation of the detonator D.

A retaining ring 214 is mounted with a lower portion **174*a* of the piston 174 (FIG. 2B) forming a lower limit for downward movement of the housing 176 with respect to piston 174 in response to the forces exerted by the spring 175.**

A backup ring 216 and a bearing retainer 218 are mounted between the delay housing sub 200 and a ball bushing housing sub 220. An annular passage **216*a* is formed in the backup ring 216 to permit fluid passage therethrough. A ball bushing 222 is mounted within the retaining ring 218 permitting relatively free movement of the piston 174 therethrough. The delay housing sub 200 and the ball bushing sub 220 are threadedly engaged along threaded surfaces 224 with an O-ring 226 or other suitable sealing rings mounted therebetween. The chamber 220*a* of sub 220 receives fluid, in a manner to be set forth below, of like characteristics to the fluid in the upper portion of the sensor S above the ball bushing sub 220.**

Figure 2C:
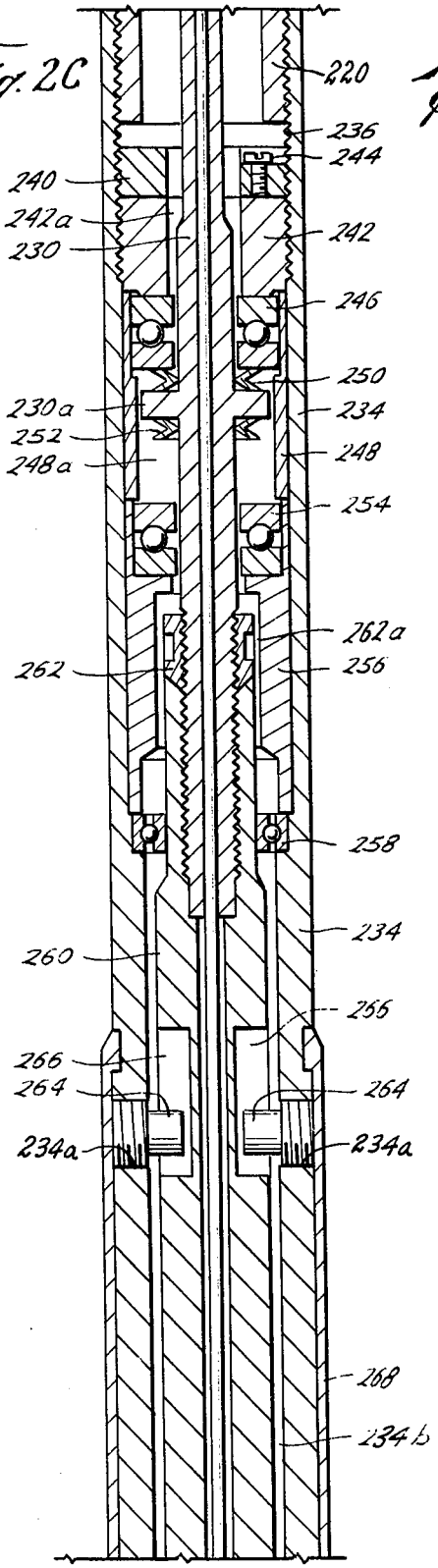
Figure 2D:
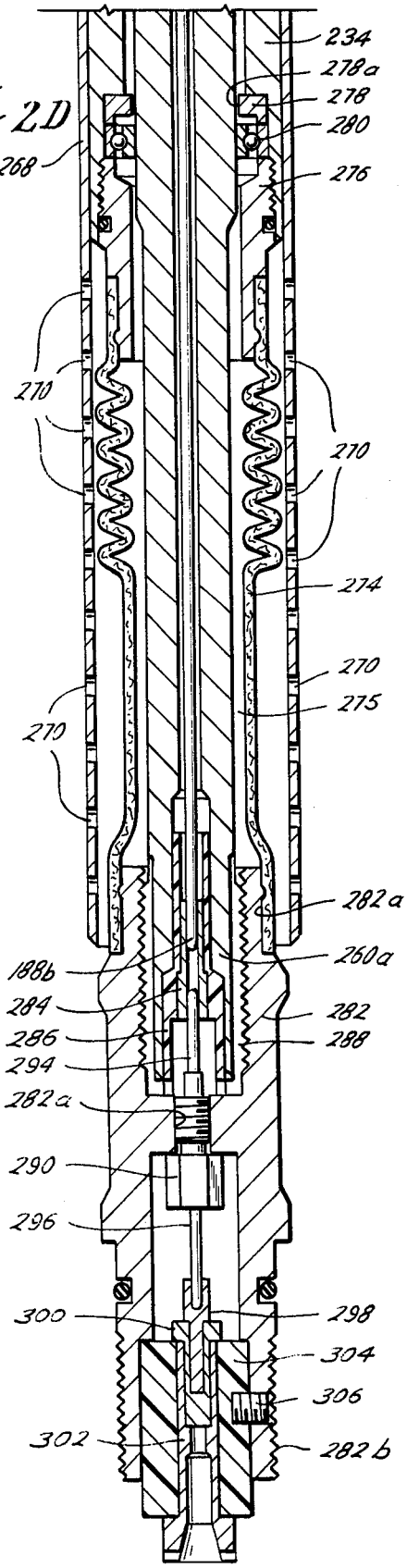

A jam nut 228 is used to mount the piston 174 to a positioning member 230 at an upper end thereof. A ground screw 232 mounts an upper end of an electrical ground wire so that the positioning member 230, time delay piston 174 and contact fingers 166 may be electrically grounded. Of course, this screw 232 does not contact the shooting lead 188. A lower housing 234 is mounted with the ball bushing sub 220 along a threaded surface 236 (FIG. 2C). An O-ring 238 or other suitable means is mounted therebetween (FIG. 2B). A groundwire nut 240 (FIG. 2C) and a bearing lock nut 242 are mounted with the threaded surface 236 in the interior of the lower housing member 234 with a screw 244 inserted into the ground wire nut 240 in order that the electrical ground wire may be mounted therewith and form an electrical ground connection for the positioning member 230 and contact fingers 166. A flexible ground wire, not shown, is connected between the ground screws 232 and 244 for this purpose. An upper limit bearing 246 is mounted between the bearing lock nut 242 and a bearing sleeve 248 mounted within the lower housing member 234. The upper bearing 246 engages an upper limit washer 250 mounted on an outwardly extending collar **230*a* formed on the positioning member 230 when the upper bowspring U and the lower bowspring G are in a closed position relative to each other and the apparatus A is in the sensing position for freepoint operations (FIG. 2C**).

A lower limit washer 252 is mounted beneath the collar **230*a* on the positioning member 230 and engages a lower bearing 254 (FIG. 3) when the upper bowspring U has been moved upwardly with respect to the lower bowspring G by exertion of sufficient force at the well surface on the wireline W, so that the shooting contacts 180 engage the shooting insert ring 190 for backoff operations, or when it is desired to permit the reference spring 156 to move the sensor S to the proper position for sensing operations, as will be more evident below. A chamber 248***a* within the bearing sleeve 248 and an annular passage 242*a* in the lock nut 242 receive fluid and permit fluid to be introduced therethrough to the chamber 220*a* thereabove.

A limit pin sleeve 256 is mounted between a support bearing 258 and the lower bearing 254 within the lower housing 234. The support bearing 258 permits rotational and longitudinal movement of a stress transfer member 260 and the positioning member 230 with respect to the lower housing 234 in response to relative movement between the upper bowspring U and the lower bowspring G. A positioning member lock nut 262 mounts the positioning member 230 with the stress transfer member 260. An interior passage 262*a* between the lock nut 262 and the pin sleeve 256 receives fluid and permits fluid passage upwardly therethrough to chambers 248*a* and 220*a*.

Inwardly extending limit pins 264 are mounted in threaded sockets 234*a* formed in the lower housing 234. The limit pins 264 extend inwardly into corresponding slots 266 formed in the stress transfer member 260 to limit relative rotational movement and act as centralizers between the lower housing 234 and the stress transfer member 260. A cylindrical shield member 268 having a plurality of perforations or openings 270 formed therein is mounted with the lower housing member 234 to protect a flexible separator 274 during movement of the apparatus through the well bore B. An annular passage 234*b* (FIG. 2C) between the lower housing 234 and the stress transfer member 260 receives fluid and permits upward flow of such fluid as fluid is introduced until such passage and the chambers and passages thereabove are fluid-filled.

A bearing retainer 276 and a damper ring 278 (FIG. 2D) mount a separator bearing 280 with a lower end of the housing member 234 permitting movement of the stress transfer member 260 with respect to the housing 234 in a like manner to the bearing 258. The damper ring 278 has a shoulder 278*a* extending inwardly towards the stress transfer member 260 to restrict fluid flow therebetween during backoff operations, protecting the apparatus A from damage due to rapid movement. A lower sub 282 is threadedly mounted with a threaded lower end 260*a* of the stress transfer member 260 in order to couple the stress transfer member 260 to the lower bowspring G. The flexible separator 274 is mounted with the bearing retainer 276 along a lower portion and at an outer upper surface 282*a* of the lower sub 282 (FIG. 2D), forming a fluid receiving chamber 275 between the flexible separator 274 and the stress transfer member 260.

The shooting lead 188 extends downwardly from the piston 174 (FIG. 2B), as has been set forth, through the positioning member 230 and the stress transfer member 260 to a bare or uncovered conductive lower end 188*b* (FIG. 2D) of the shooting lead 188 mounted in a connector jack 284 which is held in place by a lower insulator 286.

Fluid passage ports 288 are formed in the threaded lower portion 260*a* of the stress transfer member 260 adjacent the lower sub 282 in order to permit passage of fluid through an opening adjacent a fluid seal nut 290 into the lower portion of the sensor S. The fluid seal nut 290 is mounted with a threaded surface 282*a* formed in the lower sub 282. The fluid seal nut 290 is removed so that the sensor S may be filled by means of a funnel or other suitable means with the silicone base fluid, of the type set forth above, for operations in the well bore B. When the sensor S is filled with fluid, the fluid seal nut 290 is mounted with the lower sub 282, sealing the fluid within the sensor S.

A connector plug 294 is formed extending upwardly into the connector jack 284 and electrically connects the shooting lead 188 to the metallic fluid seal nut 290. A connector plug 296 is formed extending downwardly from the metallic fluid seal nut 290 into a lower jack 298 which is mounted in a receiving socket 300, which together with a contact insert 302 are mounted with an insulator 304 by a set screw 306 at the lower end of the lower sub 282. The contact insert 302 receives a banana plug (not shown) from the lower bowspring G. The lower bowspring G is mounted with a threaded external surface 282*b* of the lower sub 282 in order to mount the lower bowspring G therewith. The contact insert 302 provides electrical connection between the shooting lead 188 and the detonator D through the lower bowspring G in the conventional manner in order that backoff operations may be performed with the detonator D.

TRANSFORMER SUBASSEMBLY

Figure 6:
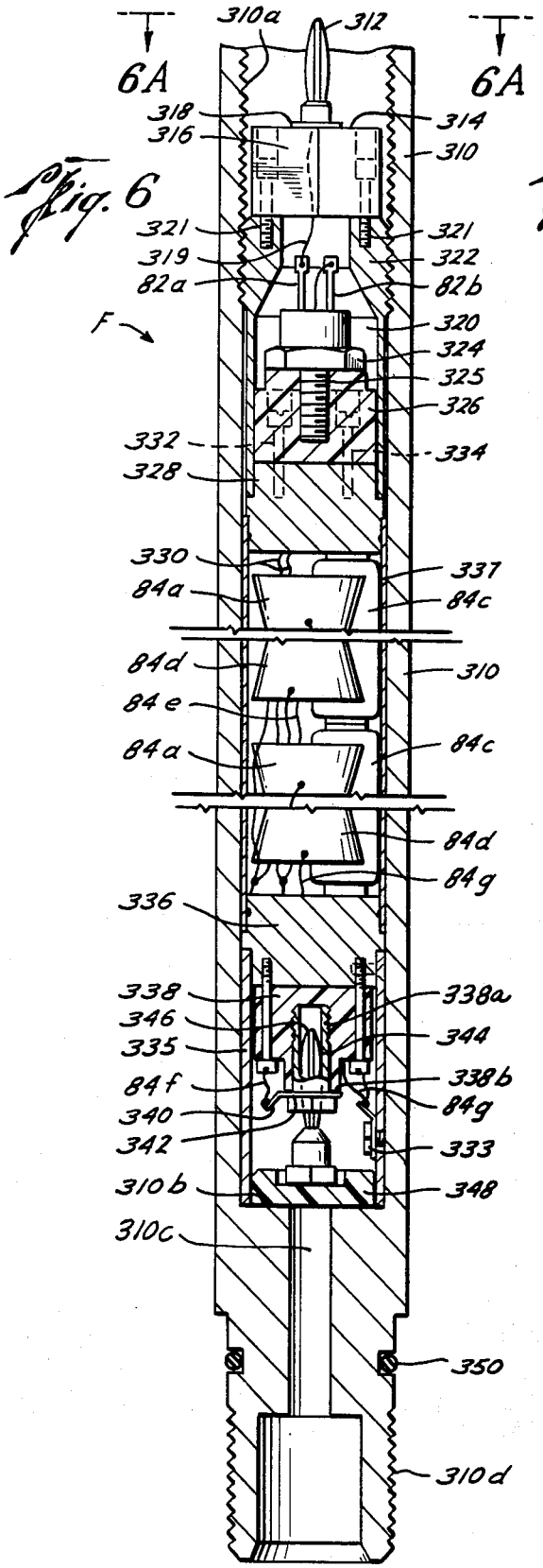
FIG. 6 is a side view taken partly in section of a transformer subassembly of the apparatus of FIG. 1.
Figure 6A:
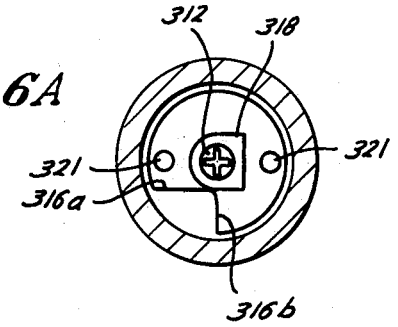
FIG. 6A is a cross-sectional view taken along the lines 6A—6A of FIG. 6.

The transformer subassembly F (FIGS. 1, 6 and 6A) receives the reduced current level alternating current from the wireline W through the upper subassemblies including the slip joint J, the collar locator L, the upper bowspring U, the sensor subassembly S and the lower bowspring G. The transformer subassembly F is mounted along a threaded internal surface 310*a* of a subassembly housing 310 to a threaded lower portion (not shown) of the lower bowspring G. A banana plug 312 is inserted into a contact insert (not shown) mounted in the lower bowspring G, forming an electrical connection therebetween. The banana plug 312 is mounted with an upper surface 314 of an upper insulator plug insert 316. A pieshaped portion of the insulator plug insert 316 is removed adjacent surfaces 316*a* and 316*b* (FIG. 6A) to allow clearance for wire, etc. A solder lug 318 is formed extending outwardly from the banana plug 313 on the upper surface 314 of the insulator plug insert 316 in order that an electrical conductor 319 may electrically connect the banana plug 312 to a first contact 82*a* of the Zener diode 82. The contact 82*a* and a second contact 82*b* are formed extending upwardly from the Zener diode 82 into an interior hollow portion 320 of a spacer 322 which supports the insulating block 316. A pair of screws 321 are inserted into threaded sockets in the insulating block 316 and spacer 322 to mount the block 316 with the spacer 322. The Zener diode 82 is mounted with a lock nut 324 which is engaged in a threaded socket 325 of an insulating spacer 326 above an upper plug 328. A set of screws 332 mounts the insulating spacer 326 with the upper plug 328.

A pair of electrical conductors 330 electrically connect the second contact 82*b* of the Zener diode 82 through the insulating spacer 326 to the input terminals of the pair of primary coils 84*a*. The conductors 330 preferably pass through suitable grooves (not shown) formed in spacer 326 and plug 328. A second conductive screw 334 in the plug 328 forms an electrical ground.

As has been set forth above, each of the primary coils 84*a* has an individual common core 84*c* magnetically linking primary coil 84*a* with a secondary coil 84*d*. The turns ratios of the primary coils 84*a* and the secondary coils 84*d* are chosen so that a significant increase in the current level sent down the wireline W is formed in the transformers 84 so that reduced current levels may be sent down the wireline W to increased depths and then increased in the transformer F to a sufficiently high level to operate the detonator D. A metallic sleeve 337 is mounted in the housing 310 to retain a suitable protective potting electrical resin for the transformer 84 therein.

The return conductor 84*e* (FIGS. 1 and 6) electrically connects the side of the primary coils 84*a* opposite the input terminals to a ground screw 333 mounted in a spacer sleeve 335, electrically grounding the primary coils 84. The return conductor 84*e* passes through suitable grooves (not shown) formed between the subassembly housing 310, the lower plug 336, a lower insulator 338 and the spacer sleeve 335.

A lower plug 336 is mounted by set screws with the spacer sleeve 335 in the transformer subassembly 310, and a lower insulator 338 is mounted therewith by suitable screws 339 or other fastening means.

The conductor 84*f* (FIGS. 1 and 6) electrically connects an output terminal of secondary coils 84*d* of the transformer F to a contact tab 340. The ground conductor 84*g* electrically grounds the other terminal of the secondary coils 84*d* to the ground screw 333. The contact tab 340 is formed extending outwardly from a conductive disk 342. The conductive disk 342 is held in place adjacent a lower end 338*b* of the lower insulator 338 by a contact insert 344 having a threaded external surface for insertion into and engagement with a threaded internal surface formed adjacent a socket 338*a* in the lower insulator 338. A conventional banana plug 346 is mounted with its associated washer and lock nut atop a lower insulator mount 348 adjacent a lower surface 310*b* within the transformer housing 310. A conductor 310*c* is formed in the transformer housing 310 extending downwardly from the surface 310*b* to permit insertion of contact inserts or other suitable conventional electrical connectors so that electrical connection is provided between the banana plug 346 and the detonator subassembly D therebeneath.

A threaded external surface 310*d* is formed at a lower end of the transformer housing 310 in order that the transformer subassembly F may be mechanically connected with the detonator subassembly D therebeneath. An O-ring 350 or other suitable sealing means is mounted for sealing between the lower end of the transformer housing 310 and the detonator subassembly D.

OPERATION OF INVENTION

In the operation of the present invention, should the pipe P become stuck in the well bore B during drilling or other operations, the downhole tool T of the apparatus A is lowered by the wireline W to a suitable test point in the pipe P in the conventional manner. When the casing collar locator L indicates that the tool T is at the desired test point, sufficient tension is exerted on the wireline W from the surface in the conventional manner to move the upper bowspring U with respect to the lower bowspring G, moving the fingers 166 out of contact with the cup 164, permitting the reference spring 156 to move the core pieces of the sensors S into the reference position for freepoint testing, with the tool T in the first operating or freepoint sensing position (FIGS. 2A–2D).

The pipe P is then stressed, by being stretched or torqued, from the surface in the conventional manner, and for points above the stuck point 10, the upper bowspring U moves with respect to the lower bowspring G in response to movement of the pipe P, causing a change in the reluctance of the two magnetic circuits in the sensor S, causing the sensor S to form the offset current 73 on the wireline W which is sensed in the monitor circuit M.

When the tool T is located at or below the stuck point 10, the force applied to the pipe P does not cause relative movement between the bowsprings U and G, due to the stuck pipe P thereabove. Accordingly, the sensor S forms no offset current, indicating at the monitor M the stuck pipe P.

The invention magnetic sensor circuitry is so sensitive that it can detect motion between the upper and the lower bow springs over merely the length of the tool, about five feet in the successfully constructed embodiment, even when the tool is in free pipe. When the tool is in stuck pipe, no such relative motion occurs. In use therefore, the stuck location is bracketed. That is, the operator starts above the stuck position detecting motion as he moves the tool down the pipe until finally no motion is detected. The change is indicative of the location of the stuck pipe. In operation, the operator pulls on the wire line W, and the outside housing moves up, striking the underside of the cup 210. The cup 210 moves up, compressing the spring 175 and forcing oil out of the valve V. During that step the lower bow spring and the piston 174 attached thereto do not move at all. Next the fingers 166 are squeezed, and the sensor is released for use. Then the operator relaxes the wire line. This releasing of the wire line causes the upper bow spring to move, while the lower one still remains stationary. At this point the floating piston 176 is no longer being pushed up, and the spring 175 is free to push the floating housing 176 down with respect to the fixed piston 174. This creates a partial evacuated condition in the chamber 178.

In order to free the pipe P above the stuck point 10, the downhole tool T is moved to the desired shot location in the pipe P by the wireline W in the conventional manner. Sufficient force is then exerted on the wireline W to move the tool T into the second operating or backoff position (FIG. 3) and maintain the tool T in such position with the shooting contacts 180 in electrical connection with the shooting insert ring 190, forming an electrical connection between the wireline W and the transformer sub F.

The control switch K of the surface electronics E is then moved to electrically connected the control circuit C to the wireline W, and switches 20 and 22 are depressed sending alternating current through the current-decreasing transformer 24 through the wireline W, the shooting contact ring 190 and the shooting contacts 180 to the transformer sub F. The current increasing transformer coils 84*a* in the transformer sub F increase the level of the current from the wireline W so that sufficient amperage is present to ignite the detonator D and free the pipe P above the point where backoff operations are being performed.

Ignition of the detonator D moves the portions of the tool T operably connected with the lower bowspring G upwardly to an intermediate position (FIG. 4). However, the time delay piston 174 prevents rapid movement of the apparatus from the second operating position (FIG. 3) to the first operating position (FIGS. 2A and 2B) and consequently prevents the fingers 166 from contacting the cup 164 until the time interval determined by the rate of fluid flow through the leakage orifices 212 and 176c has elapsed, protecting the sensor S from shock and damage during backoff operations and protecting the portions of the toll T above the detonator D which move the backoff detonator D through the pipe P from such shock and damage.

The firing fingers 180 do contact the shooting ring 190 each time the tool is moved. However, the shot does not fire unless the selector switch K at the surface is in position to supply energy to the transformer to in turn fire the shot. That is, the firing mechanism is enabled each time the tool is moved, but the current is not supplied until it is desired to fire the shot.

TEMPERATURE SENSING APPARATUS

Figure 12:
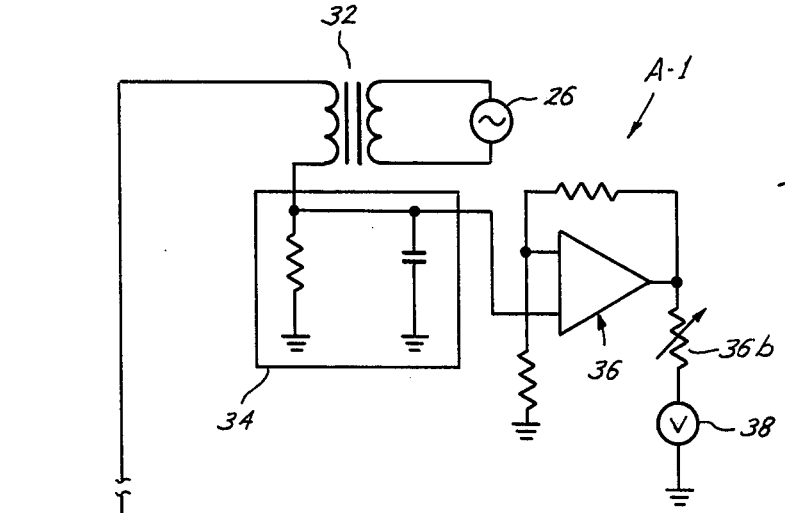
FIG. 12 is a schematic diagram of a temperature sensing apparatus of the present invention.

In a remote temperature sensing apparatus A-1 (FIG. 12) of the present invention, like structure and components to that of the apparatus A bear like reference numerals. In the apparatus A-1, the oscillator or alternating current source 26 sends electrical current through the isolation transformer 32 down the wireline W to a remote sensor S-1 mounted in a suitable capsule in the well bore for a sensing temperature conditions therein.

The remote sensor S-1 includes a first resistor 360 electrically connected between the unidirectionally conductive diode 74 and the electrical ground contact 78. The resistor 360 has a resistivity temperature coefficient of substantially zero, so that the resistance value thereof is substantially temperature invariant. The sensor S-1 further includes a second resistor 362 electrically connected between the ground contact 78 and the diode 76. The resistor 362 has a resistivity temperature coefficient of some finite number, such as four parts per thousand. The resistance value of the resistor 362 is selected to equal that of the temperature invariant resistance 360 at a predetermined temperature, for example 0°F. When the sensor S-1 is lowered into the pipe P of the well bore B to sense temperature conditions therein, the resistance value of the resistor 362 changes in accordance with the damage in temperature therein, while the resistance value of the resistor 360 remains substantially constant. Accordingly, when the alternating current from the generator 26 is received over the wireline W for positive half-cycles through the diode 74, the current through the resistor 360 does not change. However, on the negative half-cycles through the diode 76, the current through the resistor 362 decreases, forming an offset current which can be monitored by the integrator 34 in the manner set forth above and the voltage level representing the accumulated offset current in the integrator 34 is amplified through the amplifier 36 and provided through the calibration resistor 36b to a meter 38 so that temperature conditions in the well bore may be sensed by the apparatus A-1.

INCLINOMETER

Figure 13:
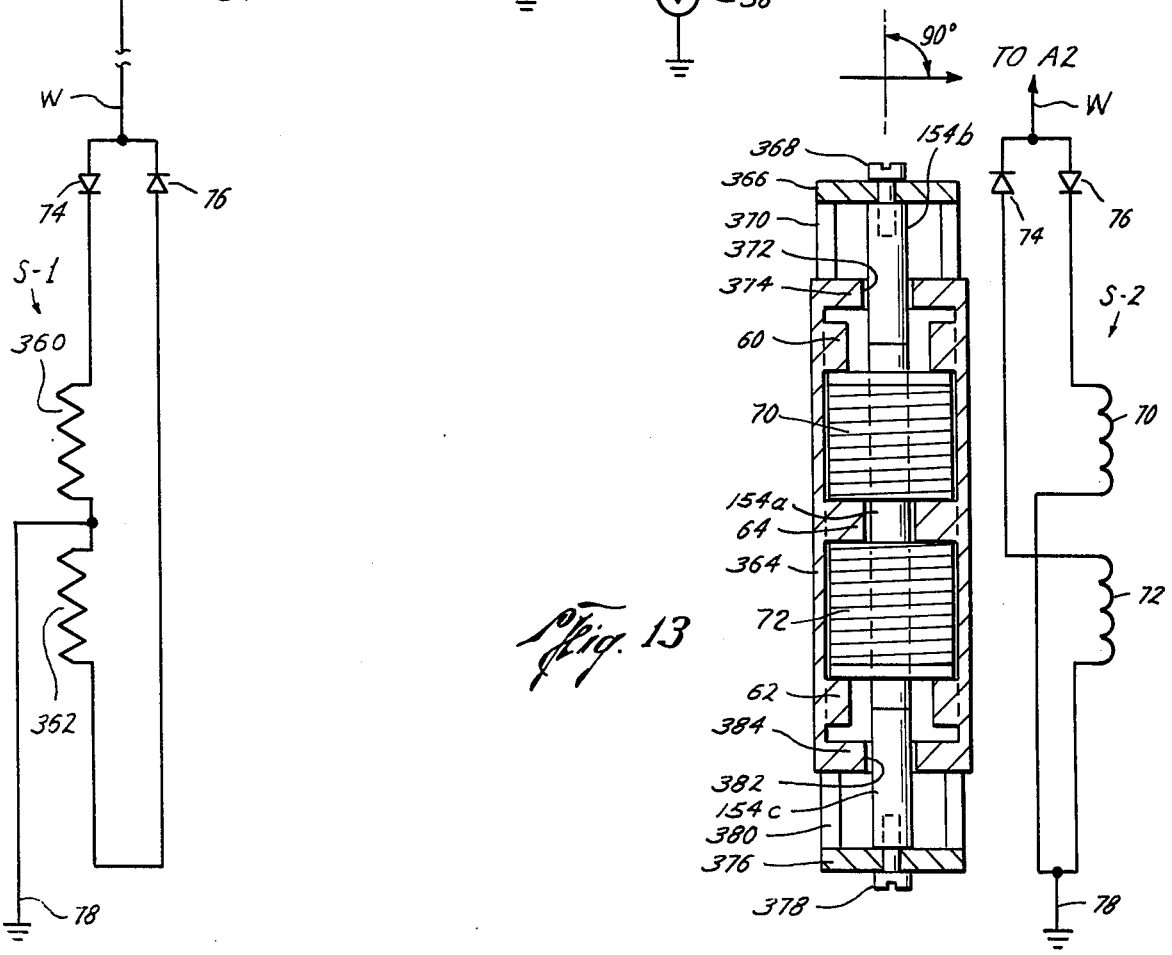
FIG. 13 is a schematic diagram of an inclinometer apparatus of the present invention.

In an inclinometer apparatus A-2 of the present invention (FIG. 13), like structure to that of the apparatus A and A-1 bears like reference numerals. The apparatus A-2 is used for sensing the inclination of a well bore.

The apparatus A-2 receives alternating current operating power from the generator or oscillator 26 which is provided through the isolation transformer 32 down the wireline W to an inclinometer S-2 of the apparatus A-2.

The sensor S-2 is a modified embodiment of the sensor S, being mounted in a ferromagnetic cylindrical case 364. The sensor S-2 has the upper and lower stator cores 60 and 62 and the intermediate core 64 forming a magnetic circuit in conjunction with the ferrous center portion 154a of the shaft 154.

The shaft 154 is mounted at the upper end 154b to a support leaf spring 336 by a screw 368. The support spring 366 engages a cylindrical spacer 370 at outer ends thereof and suspends the shaft 154 therebelow. The support shaft 154 extends from the support spring 366 through an enlarged opening 372 formed in a circular end plate 374 of the sensor S-2. The enlarged opening permits free movement of the shaft 154 with respect to the case 364 of the sensor S-2.

The shaft 154 is mounted at a lower end 154c with a second support leaf spring 376 by a screw 378 or other suitable mounting means. The support spring 376, in a like manner to the support spring 366 is mounted at outer ends thereof with a cylindrical spacer 380. The lower end 154c of the shaft 154 extends through an enlarged opening 382 formed in a lower end plate 384 of the sensor S-2.

The sensor S-2 is calibrated by having the shaft 154a mounted therein so that the inductance of the coils 70 and 72, as influenced by the magnetic circuits formed by the stators 60, 62 and 64 therein, is substantially equal when the sensor S-2 is vertically suspended. The sensor S-2 is mounted in a suitable casing and lowered into the pipe P and the well bore B by the wireline W. As the well bore B deviates from vertical, the weight of the shaft 154 exerting a downward force on the support spring 366 becomes less, due to the deviation from vertical, permitting the support spring 366 to move the shaft 154 upwardly, changing the reluctance parameters of the magnetic circuits affecting the coils 70 and 72, forming the offset current which is accumulated in the integrator 34 to provide a voltage level through the amplifier 36 and the calibrating resistance 36b to the meter 38 in order to indicate the deviation of the well bore B from true vertical.

ALTERNATING CURRENT FREEPOINT INDICATOR

The motions along the axis of the shaft 164 are very small, in the neighborhood of millionths of an inch or thousandths of an inch at the most. The compressability of the insulator caps on the coils 70 and 72 is sufficient to allow these small motions to in turn produce meaningful results in regard to inclination of the bore hole.

Figure 14:
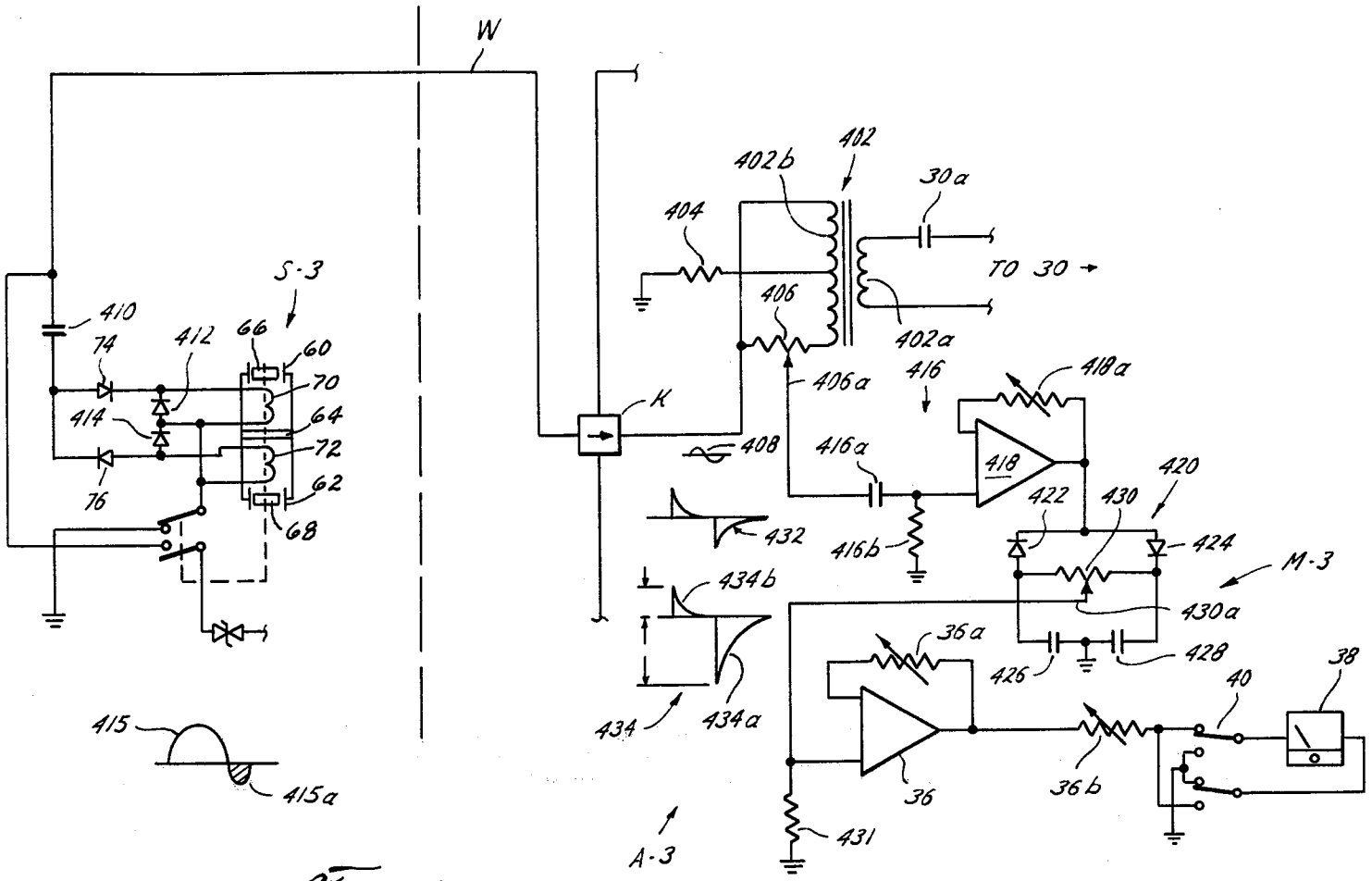
FIG. 14 is a schematic diagram of an alternative apparatus of the present invention.

In certain wells, the presence of salt water in fluids in the well bore B often gives rise to galvanic electromotive forces, reducing the effectiveness of the apparatus A which forms direct current offset signals during freepoint testing, in the manner set forth above. An apparatus A-3 (FIG. 14) with a sensor S-3 operating to form alternating current derivative pulse signals to indicate freepoint in the pipe P is adapted for use in these wells. In the apparatus A-3, like structure to that of the apparatus A performing like functions bear like reference numerals, while certain portions of the apparatus A-3 unmodified from, and operating in the same manner as in the apparatus A, such as the collar L, transformer F, detonator D, detonator control circuit C, and indicator circuit I are not shown in the drawings (FIG. 14) for purposes of brevity and to preserve clarity therein.

A transformer 402 receives the output from the amplifier 30 through the capacitor 30*a* in a primary winding 402*a*. A secondary winding 402*b* of the transformer 402 is electrically connected to ground through a line ballast resistor 404. The secondary winding 402*b* of the transformer 402 is electrically connected through a line nulling potentiometer 406, the switch K and the wireline W to the sensor S-3, providing an alternating current signal indicated by a waveform 408.

In the sensor S-3, a D.C. blocking capacitor 410 receives the input signal from the wireline W while preventing direct current formed due to galvanic action in the well bore B from affecting the sensor S-3. Diode 74 energizes the coil winding 70 on alternate half-cycles in the manner set forth above, while damper diode 412 prevents reverse current flow through coil 70. The reverse current flow prevented by the diode 412 is that which would otherwise occur (as indicated by a shaded portion 415*a* of a waveform 415) due to the abrupt termination of current flow of input signal to the coil 70 from the wireline W at the end of the conductive half-cycle by the steering diodes 74 and 76.

In a like manner, diode 76 energizes the coil winding 72 on the other set of alternate half-cycles of the input signal, while damper diode 414 prevents reverse current flow therethrough due to abrupt termination of input current to the coil 72 at the end of each conductive half-cycle.

A monitor cycle M-3 of the apparatus A-3 is electrically connected to a tap 406*a* of the line nulling potentiometer 406 at a capacitor 416*a* of an R-C high-pass filter 46, which also includes a resistor 416*b*. A buffer amplifier 418, with a gain control feedback resistor 418*a* receives the output of the high-pass filter 416, and furnishes such output to a peak detector circuit 420.

In the peak detector circuit 420, steering diodes 422 and 424 pass pulses, formed in the sensor S in a manner set forth below, to storage capacitors 426 and 428, respectively on alternate half-cycles. The capacitors 426 and 428 store the charge provided in the form of pulses to the peak detector circuit 420, and provide a voltage respresenting the level of the charge so stored to opposite terminals of a potentiometer 430. A tap 430*a* of the potentiometer 430 electrically connects the peak detector 420 to the amplifier 36 at an input bias resistor 431 and to meter 38 of the monitor M-3, which operate as set forth above in the monitor M of the apparatus A.

In operation of the apparatus A-3, the sensor S-3 is lowered in the well bore B and moved to the reference or null position. With the sensor S-3 in the reference position, the coils 70 and 72 form substantially equal amplitude impulses of opposite polarity through the switch K, as indicated by a waveform 432. The potentiometer 430 of the peak detector 420 is then adjusted and calibrated so that the voltmeter 38 reads zero volts with the sensor S-3 providing the waveform 432 in the reference position.

The pipe P is then stretched or torqued, causing relative movement between the bowsprings U and G if the pipe P is not stuck.

The coils 70 and 72 respond by changes in their inductance due to relative movement of the rotor cores 66 and 68 with respect to their stator cores 60 and 62, in the manner set forth above for sensor S, forming peak-to-peak offset impulses of different magnitude and different polarity, as exemplified by a waveform 434 with a negative going impulse 434a being larger in absolute magnitude than a positive going impulse 434b due to the movement of the rotors 66 and 68 with respect to the stators 60 and 62, respectively. The pulses in the waveform 434 are carried by the wireline W through the switch K, high-pass filter 416 and amplifier 418 to the peak detector circuit 420.

The steering diode 422 passes the negative polarity pulses from the sensor S-3 for storage in the capacitor 426, while the steering diode 424 passes the positive polarity pulses from the sensor S-3 for storage in the capacitor 428. When the sensor S-3 forms offset impulses of different nagnitude in the manner set forth above, the capacitor receiving the larger magnitude impulses stores a greater charge than the other capacitor and thus attains a higher voltage level, causing a voltage drop across the potentiometer 430, which is sensed over the potentiometer tap 430a through the amplifier 36 to form an output indication of the relative movement of the sensor S-3 in response to movement of the pipe P, and the magnitude and direction of such movement.

When the sensor S-3 does not move in response to movement of the pipe P where such pipe is stuck the equal amplitude impulses formed in the sensor D-3 stored in the capacitors of the peak detector circuit 420 do not unbalance the null reading indicated on the meter 38 from the potentiometer 430, indicating the stuck pipe P.

PROBE AND COLLAR DETECTOR

Figure 15:
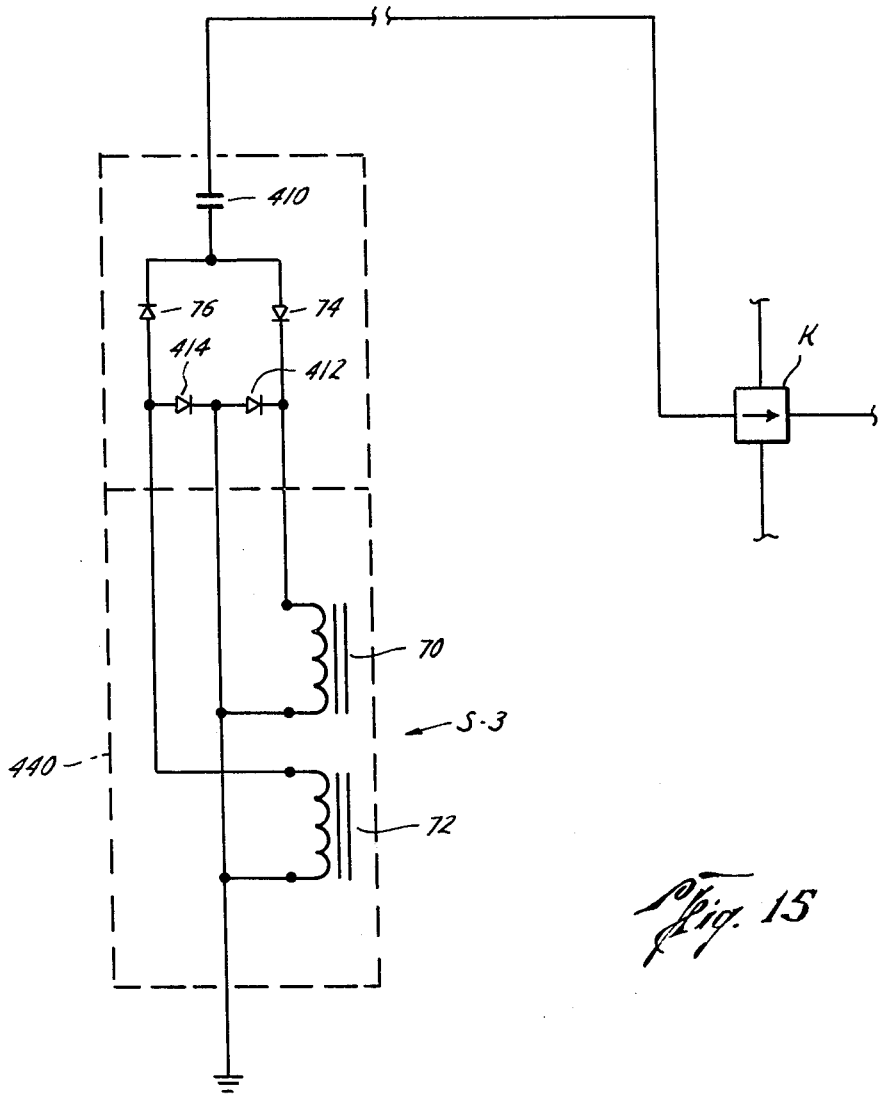
FIG. 15 is a schematic diagram of the apparatus of the present invention adapted for use as a probe and collar detector.

The sensor S-3 of the apparatus A-3 is also suitable for use, referring to FIG. 15, as a probe for ferrous objects in the well bore and as a collar detector to locate collars in the well pipe or tubing, by sensing ferrous mass changes in the well tubing. In order to insure high sensitivity as a probe or collar detector, the sensor S-3 is preferably mounted in a conventional non-ferrous case shown schematically at 440 for movement in the well bore and the rotors 64, 66, and 68 and the stators 60 and 62 are removed so that magnetic flux from each of the coils 70 and 72 links with the object to be detected, whether a ferrous object or a pair of pipe collars, rather than with the flux of the other of such coils. The electrical characteristics of the coils 70 and 72 are altered in the presence of the ferrous object or ferrous mass change to be detected.

When the sensor S-3 is used as a probe or collar locator, the fields of the coils 70 and 72 remain balanced in the presence of an object which affect both fields equally and no unbalanced indication is furnished to the monitor circuit M-3. When, however, the coils 70 and 72 of the sensor S-3 are moved into the presence of the ferrous mass, or the ferrous mass change in the tubing due to the pipe collars, to be detected so that the ferrous material unequally affects the magnetic fields of the coils 70 and 72, the sensor S-3 forms peak-to-peak offset pulses, in the manner set forth above, which is indicated by the monitor circuit M-3. The sensor S-3 can then be gradually moved and changes in the readings of the meter 38 in the monitor circuit M noted to more closely locate the ferrous object for which the sensor S-3 is probing.

The foregoing disclosure and description of the invention are illustrative and explanatory thereof, and various changes in the size, shape, materials, components, circuit elements, wiring connections and contacts as well as in the details of the illustrated circuitry and construction may be made without departing from the spirit of the invention.

I claim:

1. An apparatus for testing pipe in a well bore at a test location therein, comprising:

a. sensor means for sensing whether the pipe is stuck at the test location in the well bore;

b. reference means for moving said sensor means into a reference position from which movement of the pipe when stressed indicates whether the pipe is stuck at the test location; and c. means for causing a time delay during which said reference means moves said sensor means into the reference position after said sensor means is at the test location, wherein said sensor means is in proper reference position for accurate sensing operations.

2. The structure of claim 1, further including:

a. retaining means having a normal operating position restraining said reference means when said sensor means is moved through the well bore into position for sensing;

b. means for urging said retaining means into said normal operating position; and c. means for releasing said retaining means.

3. The structure of claim 2, wherein said means for causing a time delay comprises:

means responsive to said means for releasing for causing a time delay between operation of said means for releasing and said means for urging said sensor means into said reference position for sensing operations.

4. The structure of claim 1, further including:

a. means for mounting said sensor means between spaced upper and lower positions in the pipe; and b. means for transmitting relative movement between said upper and lower spaced positions of the pipe to said sensor means.

5. The structure of claim 1, wherein said reference means comprises:

a resilient spring moving said sensor means into said reference position.

6. The structure of claim 1, further including:

a. retaining means having a normal operating position restraining said reference means when said sensor means is moved through the well bore into position for sensing, said retaining means comprising:

1. a receiving cup mounted with said sensor means; and 2. finger means engaging said receiving cup in said normal operating position and restraining said reference means when said sensor means is moved through the well bore.

7. The structure of claim 6, further including:

a spring urging said finger means into said normal operating position engaging said receiving cup.

8. The structure of claim 6, further including:

means for moving said finger means out of engagement with said receiving cup thereby permitting said reference means to move said sensor means into said reference position.

9. The structure of claim 1, wherein said means for causing a time delay comprises:

a. a housing having a chamber therein adapted to receive a fluid;

b. a piston moving said chamber to a contracted position from an expanded position when said sensing means is at the test location;

c. means for permitting release of fluid from said chamber during movement of said piston from said expanded position to said contracted position;

d. return means for returning said piston into said expanded position from said contracted position; and e. leakage orifice means formed adjacent said chamber for permitting fluid to gradually enter said chamber as said return means moves said piston so that a time delay elapses during movement of said piston from said contracted to said expanded position.

10. An apparatus for sensing the location of stuck pipe in a well bore, comprising:

a. means for mounting the apparatus at a test location between first and second spaced portions of the pipe;

b. sensor means for detecting movement of the pipe when forces are applied thereto, said sensor means comprising:

1. stator core means operably connected with a first spaced portion of the pipe, said stator core means comprisng an annular ferromagnetic core;

2. rotor core means operably connected with a second portion of the pipe spaced from said first portion, said rotor core means comprising a ferromagnetic core mounted within said annular ferromagnetic core and being longitudinally and rotatably movable with respect to said stator core means in response to movement of the pipe;

3. inductive coil means;

4. said stator core means and said rotor core means forming a ferromagnetic circuit whose parameters change in response to relative movement between the first and second spaced portions of the pipe, varying the inductance of said inductive coil means; and c. means for transferring movement of the pipe to said sensor means when forces are applied to the pipe, wherein movement of the pipe indicates that the pipe is not stuck at the test location.

11. The apparatus of claim 10, further including:

intermediate core means operably connected with the first portion of the pipe, said intermediate core means forming a portion of said ferromagnetic circuit with said stator core means and said rotor core means.

12. The structure of claim 10, further including:

monitor means at the surface responsive to said inductive coil means for indicating movement of the pipe.

13. The structure of claim 10, wherein:

a. said annular ferromagnetic core has plural inwardly extending pole pieces formed thereon; and b. said rotor ferromagnetic core has plural outwardly extending pole pieces formed thereon.

14. The structure of claim 10, wherein said sensor means further includes:

a. a second stator core means operably connected with the first portion of the pipe;

b. a second rotor core means operably connected with the second portion of the pipe spaced from said first portion, said second rotor core means moving with respect to said second stator core means in response to movement of the pipe;

c. a second inductive coil means; and d. said second stator core means and said second rotor core means forming a second ferromagnetic circuit whose parameters change in response to relative movement between the first and second spaced portions of the pipe, varying the inductance of said second inductive coil means.

15. The structure of claim 14, wherein:

a. said stator core means and said second stator core means comprise annular ferromagnetic cores mounted at spaced positions in said sensor means; and b. said rotor core means and said second rotor core means comprise ferromagnetic cores mounted within said annular ferromagnetic cores and being rotatably and longitudinally movable with respect thereto.

16. The structure of claim 15, wherein:

a. each of said annular ferromagnetic stator cores has inwardly extending pole pieces formed thereon;

b. each of said rotor ferromagnetic cores has outwardly extending pole pieces formed thereon.

17. The structure of claim 16, further including:

reference means for moving said sensor means into a reference position at the test location from which relative movement of the pipe when stressed indicates whether the pipe is stuck.

18. The structure of claim 17, wherein said annular ferromagnetic stator cores and said rotor ferromagnetic cores have like numbers of pole faces, and wherein:

said reference means comprises means for moving said rotor ferromagnetic cores with respect to said annular ferromagnetic stator cores to a position wherein said pole faces of said stator core and said rotor core are aligned to a like extent as said pole faces of said second stator core and said second rotor core.

19. The structure of claim 17, further including:

means for mounting said rotor core and said second rotor core in said reference position with respect to said stator core and said second stator core, respectively, so that movement thereof in response to said means for transferring movement causes opposite changes in the inductance of said inductive coil and said second inductive coil.

20. The structure of claim 14, wherein said sensor means is energized by alternating current sent down a wireline from the surface of the well and further including:

a. means for alternately energizing said inductive coil and said second inductive coil on alternate half-cycles of the alternating current; and wherein b. said ferromagnetic circuit and said second ferromagnetic circuit respond to the alternating current to form an offset direct current in response to movement of said sensor means due to movement of the pipe.

21. The structure of claim 14, wherein said sensor means is energized by alternating current sent down a wireline from the surface of the well and further including:

a. means for alternately energizing said inductive coil and said second inductive coil on alternate half-cycles of the alternating current; and wherein b. said ferromagnetic circuit and said second ferromagnetic circuit respond to the alternating current to form peak-to-peak offset impulses of different magnitude and polarity in response to movement of the sensor due to movement of the pipe.

22. The structure of claim 21, further including:

blocking capacitor means for protecting said sensor means from direct current formed in the well bore.

23. A method of testing pipe at a test location in a well bore to determine whether the pipe is stuck in a well bore, comprising the steps of:

a. mounting a sensor at the test location in the well bore;

b. moving the sensor up to a reference position in the test location from which movement of the sensor in response to movement of the pipe indicates whether the pipe is stuck;

c. causing a time delay to elapse during movement of the sensor to the reference position so that the sensor may assume the proper reference position for sensing operations;

d. applying force to the pipe; and e. sensing with the sensor whether the pipe moves when the force is applied thereto.

24. The method of claim 23, further including the steps of:

a. moving the sensor through the well bore to the test location;

b. restraining the sensor against movement during said step of moving through the well bore; and c. releasing the sensor from restraint prior to said step of moving same to a reference position.

25. A method of locating the point where pipe is stuck in a well bore with a sensor portion of a free point/back-off apparatus and loosening the pipe above such stuck point with a backoff position of the apparatus comprising the steps of:

a. moving the apparatus to a first operating position for sensing operations;

b. sensing whether the pipe is stuck;

c. moving the apparatus to a second operating position for backoff operations;

d. loosening the stuck pipe; and e. preventing rapid movement from the second operating position to the first operating position during said step of loosening wherein the sensor is protected against shock and damage during loosening operations.

26. The method of claim 25, wherein the sensor portion and the backoff portion of the apparatus are electrically operated further including the step of:

preventing electrical connection between the sensor portion and the backoff portion.

* * * * *

UNITED STATES PATENT AND TRADEMARK OFFICE

CERTIFICATE OF CORRECTION

PATENT NO. : 3,942,373

DATED : March 9, 1976

INVENTOR(S) : Austin S. Rogers

It is certified that error appears in the above-identified patent and that said Letters Patent are hereby corrected as shown below:

In column 26, claim 25, line 42, change "position" to --portion--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*